US005700178A

United States Patent [19]

Cimerman et al.

[11] Patent Number: 5,700,178

[45] Date of Patent: Dec. 23, 1997

[54] EMOTIONAL EXPRESSION CHARACTER

[75] Inventors: Christopher D. Cimerman, Depew; Jennifer M. Long, East Aurora, both of N.Y.

[73] Assignee: Fisher-Price, Inc., East Aurora, N.Y.

[21] Appl. No.: 696,639

[22] Filed: Aug. 14, 1996

[51] Int. Cl.[6] ..... A63H 3/20; A63H 3/33

[52] U.S. Cl. ..... 446/301; 446/340; 446/341

[58] Field of Search ..... 446/300, 301, 446/337, 338, 339, 340, 341, 342, 343, 344, 345

[56] References Cited

U.S. PATENT DOCUMENTS

| | | | |
|---|---|---|---|
| 2,101,102 | 12/1937 | Schaeffer | 446/337 |
| 2,476,742 | 7/1949 | Lareau et al. . | |
| 2,620,593 | 12/1952 | Rockwood . | |
| 2,861,808 | 11/1958 | Musser . | |
| 2,968,121 | 1/1961 | Pearson et al. . | |
| 2,969,610 | 1/1961 | Weiner . | |
| 3,125,826 | 3/1964 | Ostrander . | |
| 3,180,054 | 4/1965 | Knott | 446/337 |
| 3,672,096 | 6/1972 | Johmann . | |
| 3,738,055 | 6/1973 | Marble . | |
| 4,164,827 | 8/1979 | Palumbo . | |
| 4,341,035 | 7/1982 | Jaworski et al. | 446/341 X |
| 4,642,710 | 2/1987 | Murtha et al. . | |
| 5,501,627 | 3/1996 | Ekstein . | |

*Primary Examiner*—William H. Grieb

*Attorney, Agent, or Firm*—Morgan, Lewis & Bockius LLP; C. Scott Talbot

[57] ABSTRACT

A child's toy is disclosed that provides for a character that is capable of both visually and audibly displaying a variety of emotional expressions and which is capable of providing these displays in combination with playing a "peek-a-boo" game with the toy character. The toy has a housing that is shaped like a teddy bear, with openings for the bear's eyes and mouth and a pair of paws that rotate to a position where both paws cover the eyes of the bear when mechanically activated by the child. The paws are mechanically interconnected to a disk mounted within the housing which contains different representations for the eyes and the mouth of the bear, each of which is configured to represent a different emotional expression, on its front surface. The representations for the eyes and the mouth of the bear appear through the eye and mouth openings in the bear's face. The face disk is rotated such that when the paws rotate to their position in front of the face of the bear, a different emotional expression representation for the eyes and the mouth is presented through the housing openings for the eyes and the mouth. When the paws move back to a position away from the face of the bear, the changed emotional expression representation for the eyes and the mouth are now visible to a child. The toy also produces an audible emotional expression representation in conjunction with the visual emotional expression. The visual and audible expression displays are coordinated such that, in combination, they provide an appropriate representation for a specific emotional state (e.g. sad, happy, sleepy, etc.).

14 Claims, 24 Drawing Sheets

EMOTIONAL EXPRESSION CHARACTER

BACKGROUND OF THE INVENTION

The invention relates to a child's toy. More specifically, the invention relates to a child's toy character that provides for changes in emotional expression.

A variety of toy apparatuses are known that provide for playing "peek-a-boo" and for changing the visual emotional expression of a toy character.

U.S. Pat. No. 3,672,096 to Johmann discloses a "peek-a-boo" doll that has arms and hands that rotate to cover and uncover the face of the doll. The arms are driven by a battery-operated electric motor and are mechanically connected through gears and cams to mechanisms that cause the doll's eyes, lips and head to move. The patent also discloses that a recorded message can be played such that the doll appears to be saying, or singing, phrases coordinated with, and appropriate to, the doll's hand and head movements, e.g. saying "peek-a-boo" when the arms rotate. However, there is no disclosure as to visual or audible changes in emotion of the doll.

Another "peek-a-boo" toy is disclosed in U.S. Pat. No. 4,164,827 to Palumbo. The patent discloses a toy that has a face with eye openings, a plate behind the eye openings that bears an eyeball design, and a pair of hands. To operate the game, a child pulls on a handle which activates a mechanical device that rotates the hands to a position in front of the face and lowers the plate containing the eyeballs such that the eyeballs disappear from view. When the handle is released, the hands rotate back away from the face and the eyes reappear.

U.S. Pat. No. 3,738,055 to Marble discloses a toy doll with openings in the eye and mouth locations of the face and a mechanism located behind the face for displaying different successive arrangements of eyeballs and dentures. In this manner, the visual facial expression of the doll is changed. The eye and denture arrangement that is displayed through the facial openings is changed by way of a mechanical activation device.

An animated liquid crystal display in the form of a face where the eyes, eyebrows, and mouth appear to move in synchronization with speech played on a cassette tape player in the toy is disclosed in U.S. Pat. No. 4,642,710 to Murtha et al.

None of the patents addressed above provide for visual and audible changes in the emotional expression of a toy character, either in combination with a "peek-a-boo" feature or independent of such a feature. Therefore, it would be desirable to provide a toy character that could provide for both visual and audible changes in emotional expression. It would also be desirable to achieve this functionality in the context of a toy character that also has a "peek-a-boo" feature. Providing a toy character that is capable of both visibly and audibly displaying changes in emotional expression, and that has a "peek-a-boo" feature to further enhance the excitement of viewing and hearing the changing expressions, would add to the enjoyment of a child that is playing with the toy character.

SUMMARY OF THE INVENTION

The drawbacks of the known apparatuses are overcome by the present invention, which provides a toy character that is capable of both visually and audibly displaying a variety of emotional expressions and which is capable of providing these displays in combination with playing a "peek-a-boo" game with the toy character. Through use of the present invention a child is able to experience changes in emotional expression through the senses of both sight and hearing and play a game of "peek-a-boo" with the toy character while experiencing the emotional displays.

The toy character provides for both visual and audible changes in emotional expression and is capable of playing a "peek-a-boo" game with a child that is playing with the toy. The toy has a housing that is shaped like a teddy bear, with openings for the bear's eyes and mouth and a pair of paws that rotate to a position where both paws cover the eyes of the bear when mechanically activated by the child. The paws are activated by pressing a mechanical button in the bear's torso. The paws are mechanically interconnected to a disk mounted within the housing which contains different representations of the eyes and the mouth of the bear, each of which is configured to represent a different emotional expression, on its front surface. The representations for the eyes and the mouth of the bear appear through the eye and mouth openings in the bear's face. The face disk is rotated such that when the paws rotate to their position in front of the face of the bear, a different emotional expression representation for the eyes and the mouth is presented through the housing openings for the eyes and the mouth. When the paws move back to a position away from the face of the bear, the changed emotional expression representation for the eyes and the mouth are now visible to a child.

The toy also produces an audible emotional expression representation in conjunction with the visual emotional expression. The visual and audible expression displays are coordinated such that, in combination, they provide an appropriate representation for a specific emotional state (e.g. sad, happy, sleepy, etc.). The audible expression is activated by engagement of the disk with electrical contacts associated with the electrical circuit that activates the audible representation.

DETAILED DESCRIPTION

Figure 1A:
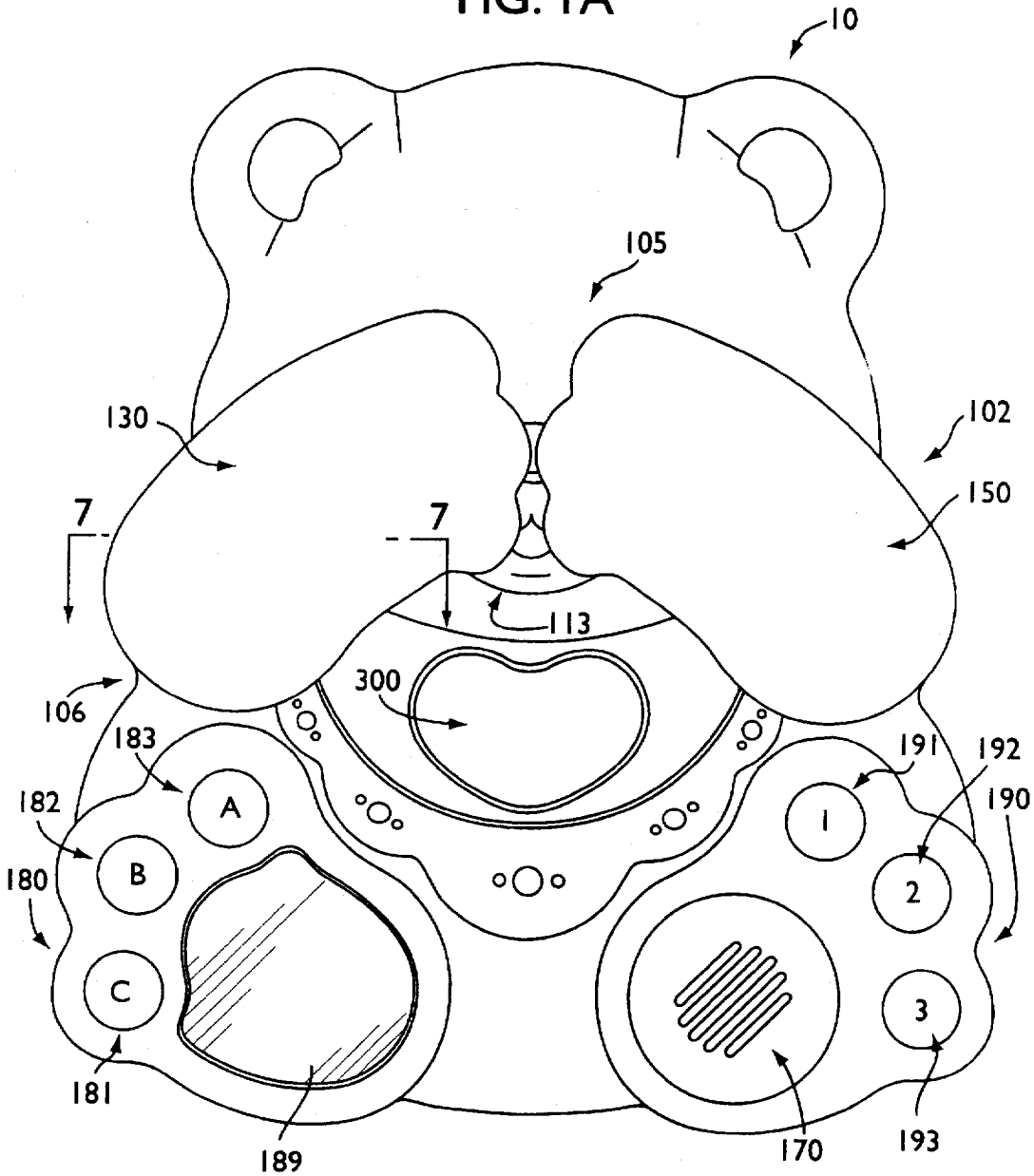
FIGS. 1A and 1B are front views of a toy embodying the principles of the invention, configured to represent a bear, with the bear's paws disposed in a position to obscure the bear's face and an alternate position to reveal the bear's face.
Figure 1B:
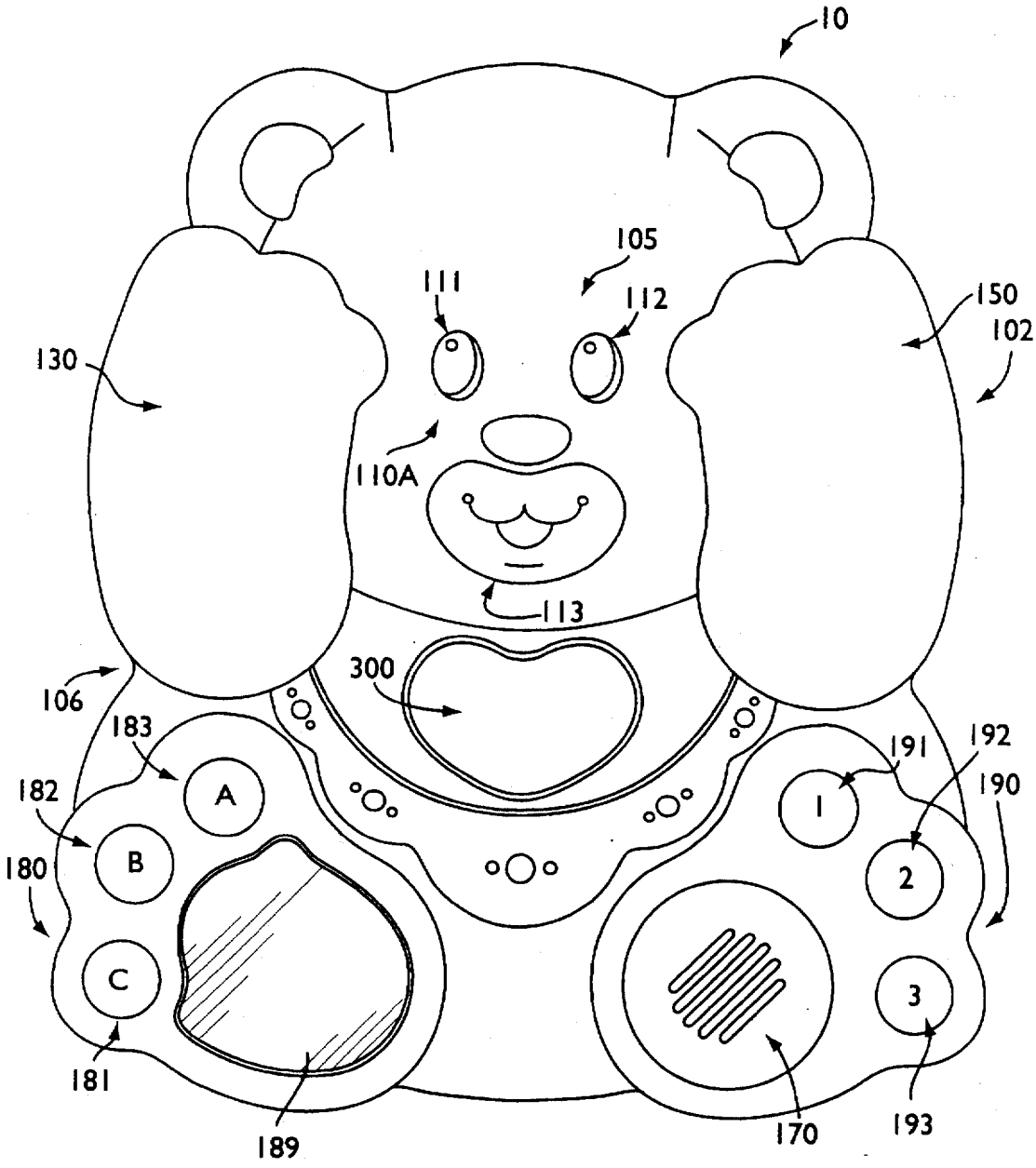

A presently preferred embodiment of an emotional expression toy embodying the principles of the present invention is illustrated in FIGS. 1–19. In this embodiment, the toy is styled as a teddy bear. As illustrated in FIGS. 1A and 1B, the teddy bear 10 has a body 102 with front housing 110 and rear housing 120 (not shown in these figures). Body 102 is shaped to represent a teddy bear, and has a face portion 105, a body portion 106, right and left foot 180, 190, respectively, and right and left paws 130, 150, respectively, mounted to front housing 110. Face portion 105 includes right and left eye openings 111, 112 and mouth opening 113, collectively forming viewing window 110A through which can be viewed graphical representations of the bear's eyes and mouth disposed on a face disk 500 mounted in face portion 105; Face disk 500 can rotate to several positions to display graphical representations of different emotional states (happy, sad, sleepy). Front housing 110 also includes an aperture in body portion 106 through which a heart-shaped actuator button 300 protrudes from the interior of body 102. Heart button 300 is used to actuate movement of paws 130 and 150, and movement of face disk 500.

Paws 130 and 150 are moveable between two positions: a first position obscuring the viewing window 110A (FIG. 1A) and a second position revealing viewing window 110A (FIG. 1B). By rotating the paws to cover and uncover the bear's face, the bear plays a "peek-a-boo" game with a child that is playing with the toy.

Teddy bear 10 also has an audio circuit that produces various audio outputs in response to various inputs by the user. The outputs include spoken expressions of the emotional state of the bear corresponding to the emotional state represented by the graphical representation on face disk 500 displayed in viewing area 110A, and simpler spoken outputs of letters or numbers. The inputs include activation of heart button 300 and letter buttons 181, 182, 183, on right foot 180 and number buttons 191, 192, 193, on left foot 190. The audio outputs are made through a speaker mounted in body 102 behind speaker opening 170.

Teddy bear 10 can be functionally divided into right and left paw assemblies, a visual and audio expression assembly, an internal actuating linkage, an actuator, and a body that supports and encloses these components. Each of these components will be discussed in turn below.

For purposes of reference herein, the right and left described locations are described with reference to the bear's right and left sides, e.g. the right paw is defined as the bear's right paw.

Right paw assembly 400 and its constituent parts are illustrated in FIGS. 4A–5E and FIG. 7. Paw assembly 400 includes right paw 130, right paw plate 140, and U-shaped spring 401. Left paw assembly 470 is identical to right paw assembly 400 and is therefore not separately described.

Right paw 130 is illustrated in FIGS. 4A–F. Right paw 130 has a flattened hemispherical body portion 133 terminating at its inner end in a circular, peripheral skirt 134. Obscuring portion 136 extends from one side of body portion 133 and is styled to suggest the toes of a bear's paw. Projecting inwardly from the inner side of body portion 133 are a cylindrical center post 135, spring-engaging rib 131, and a T-shaped stop post-engaging rib 132. Spring engaging rib is arcuate, with a radius of curvature approximately equal to its distance from center post 135. Extensions 131A, 131B project laterally inwardly (toward .center post 135) from the ends of spring engaging rib 131 to stiffen the rib.

Right paw plate 140 is illustrated in FIGS. 5A–E, and includes a disk shaped body portion 144 with a central aperture 143, a spring-engaging rib 141 projecting from the front face of body portion 144, and a cylindrical actuating post 142 projecting from the rear face of body portion 144.

Figure 7:
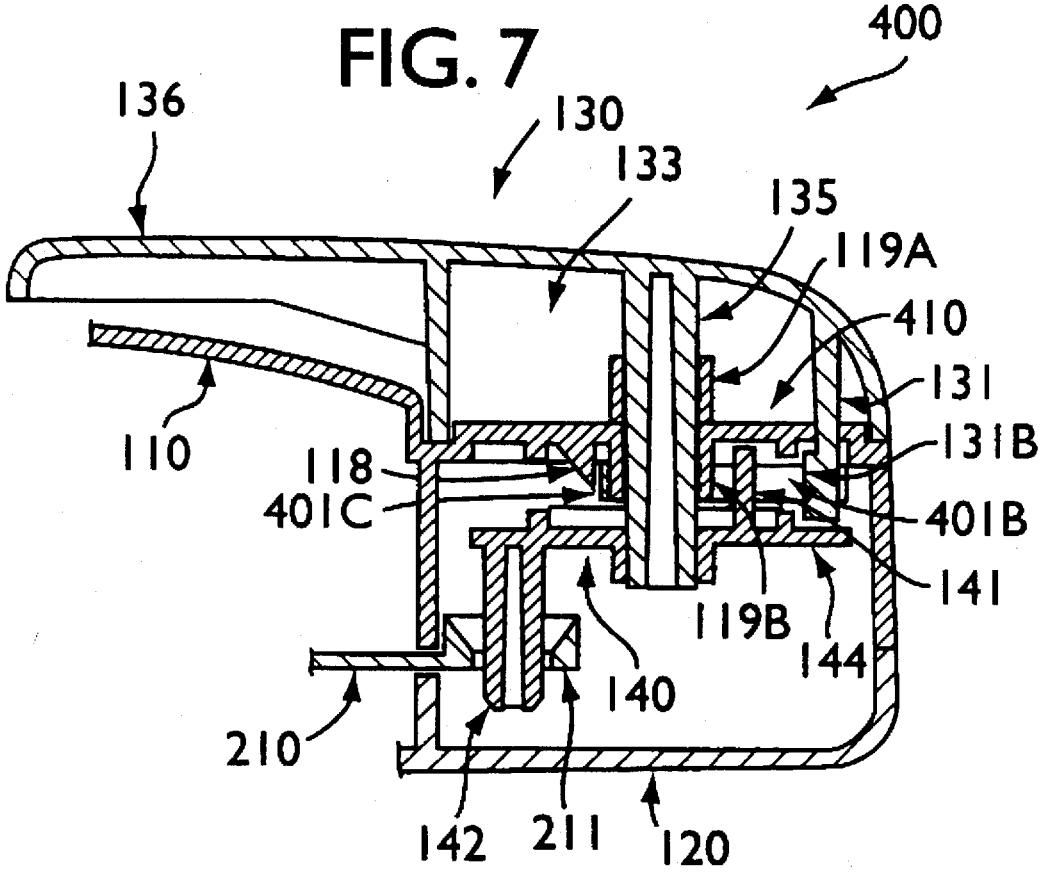
FIG. 7 is a partial cross-sectional view of the toy of FIG. 1, taken along line 7—7 of FIG. 1A, showing a paw, front housing and paw plate.
Figure 8A:
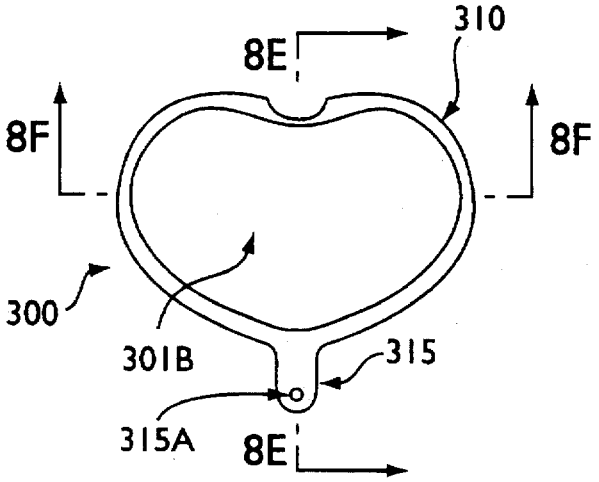
FIGS. 8A–8D are front, right side, rear, and bottom views, respectively, of the heart button of the toy of FIG. 1.
Figure 8B:
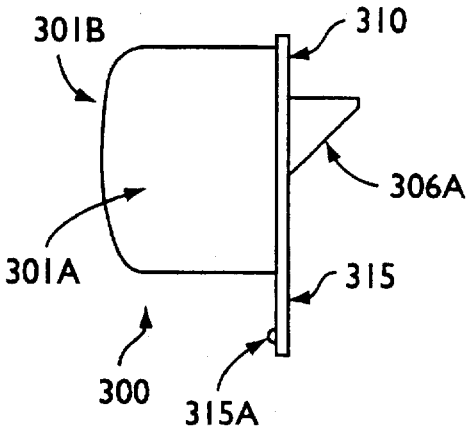
Figure 8C:
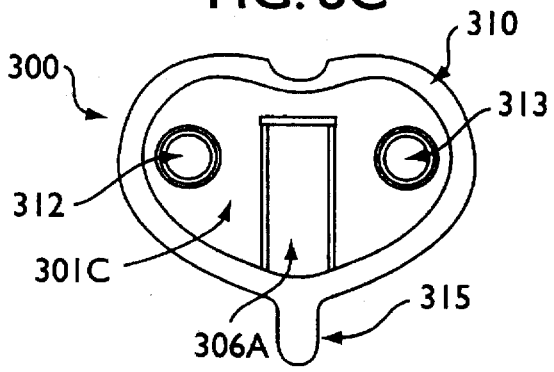
Figure 8D:
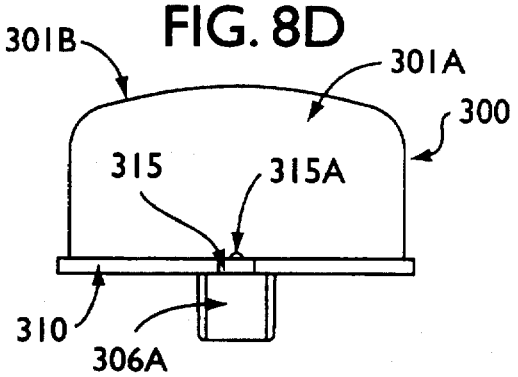
Figure 8E:
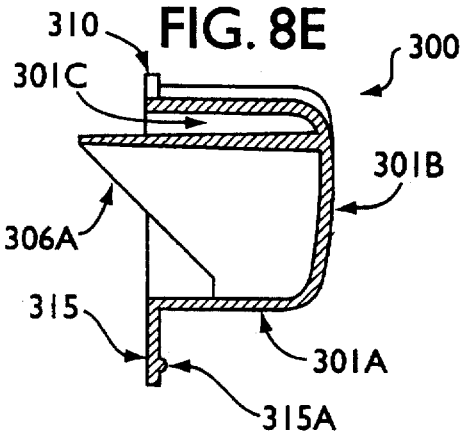
FIGS. 8E–8F are cross-sectional views of the heart button taken along lines 8E—8E and 8F—8F, respectively, of FIG. 8A.
Figure 8F:
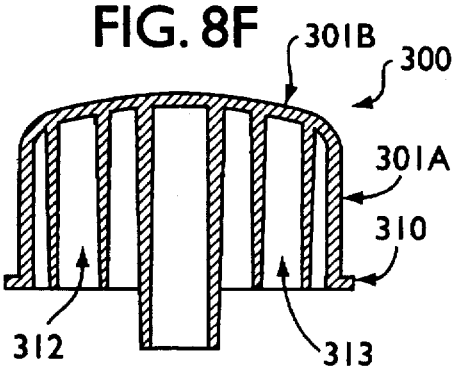
Figure 9:
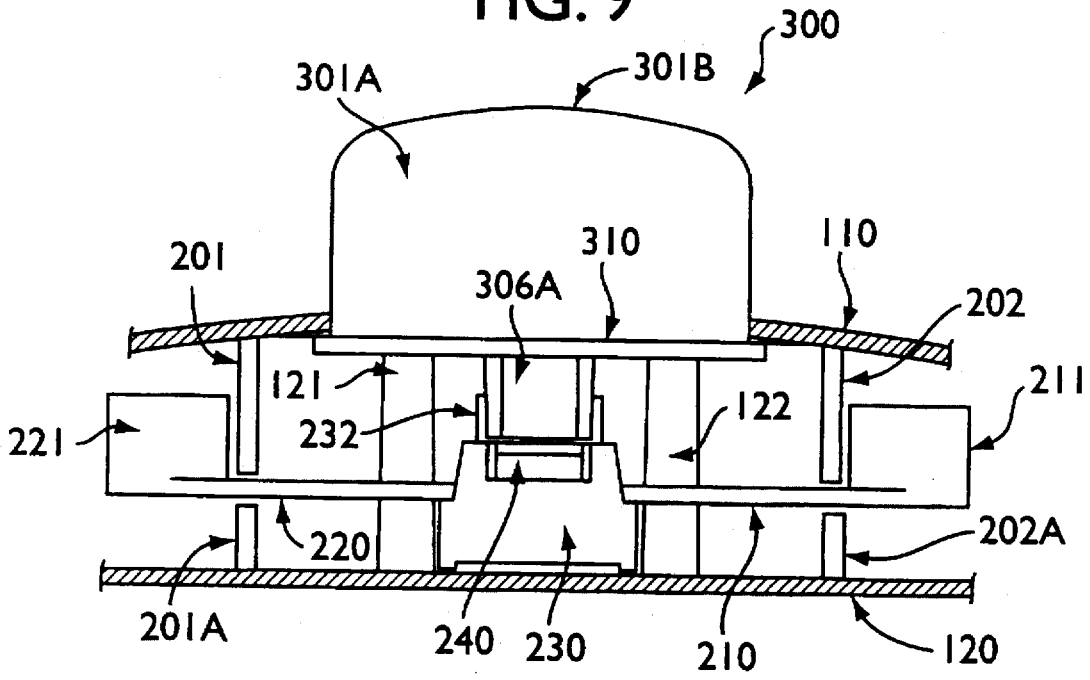
FIG. 9 is a partial cut-away top view of the toy of FIG. 1 showing the heart button and the indexer.
Figure 10A:
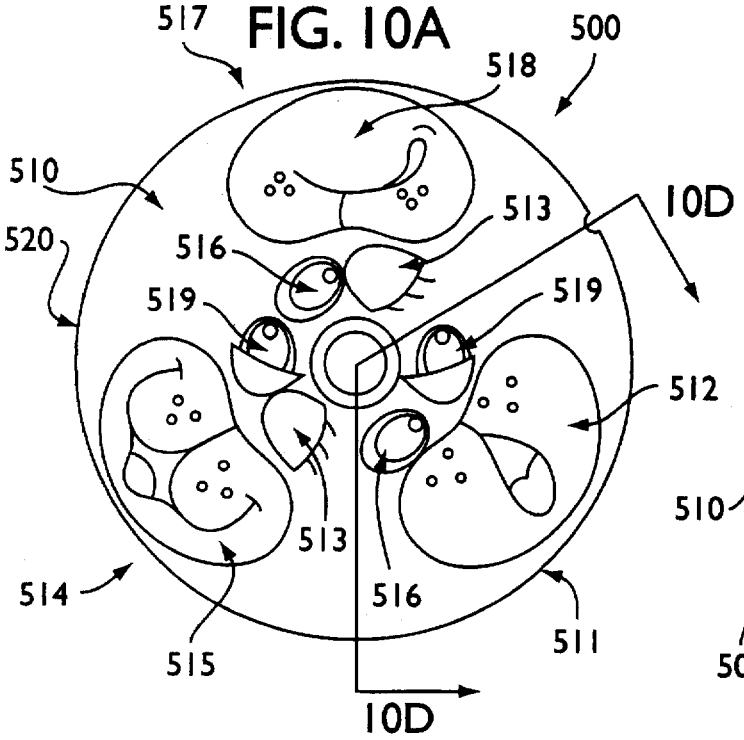
FIGS. 10A–C are front, right side, and rear views, respectively, of the face disk of the toy of FIG. 1.
Figure 10B:
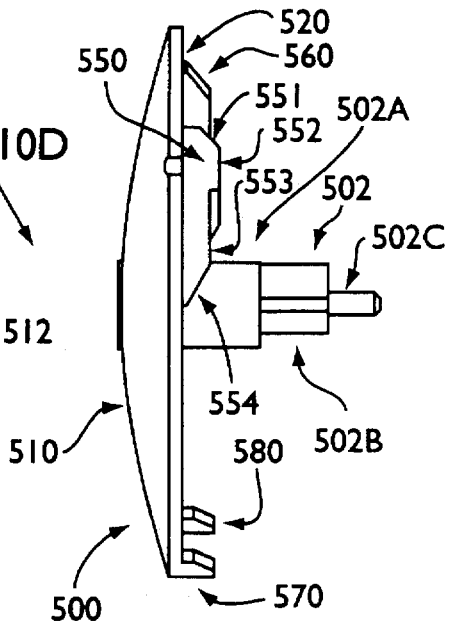
Figure 10C:
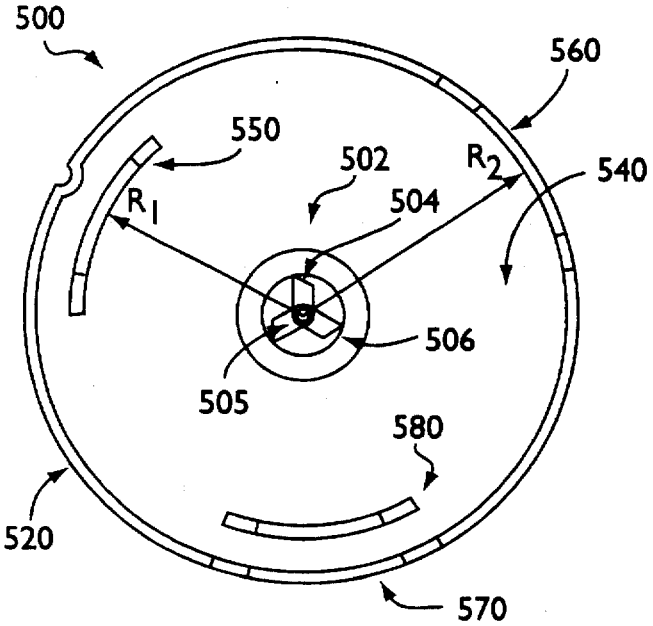
Figure 10D:
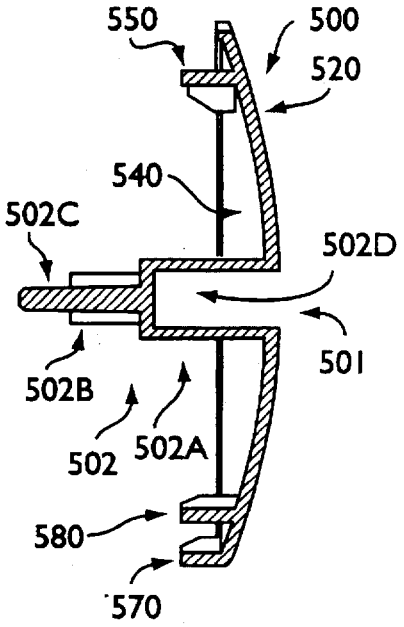
FIG. 10D is a cross-sectional view of the face disk taken along line 10D—10D of FIG. 10A.

As best seen in FIG. 7, U-shaped spring 401 is a flat piece of spring steel bent into a U shape and has first and second arms 401A (not shown), 401B, and a bight 401C.

Figure 2A:
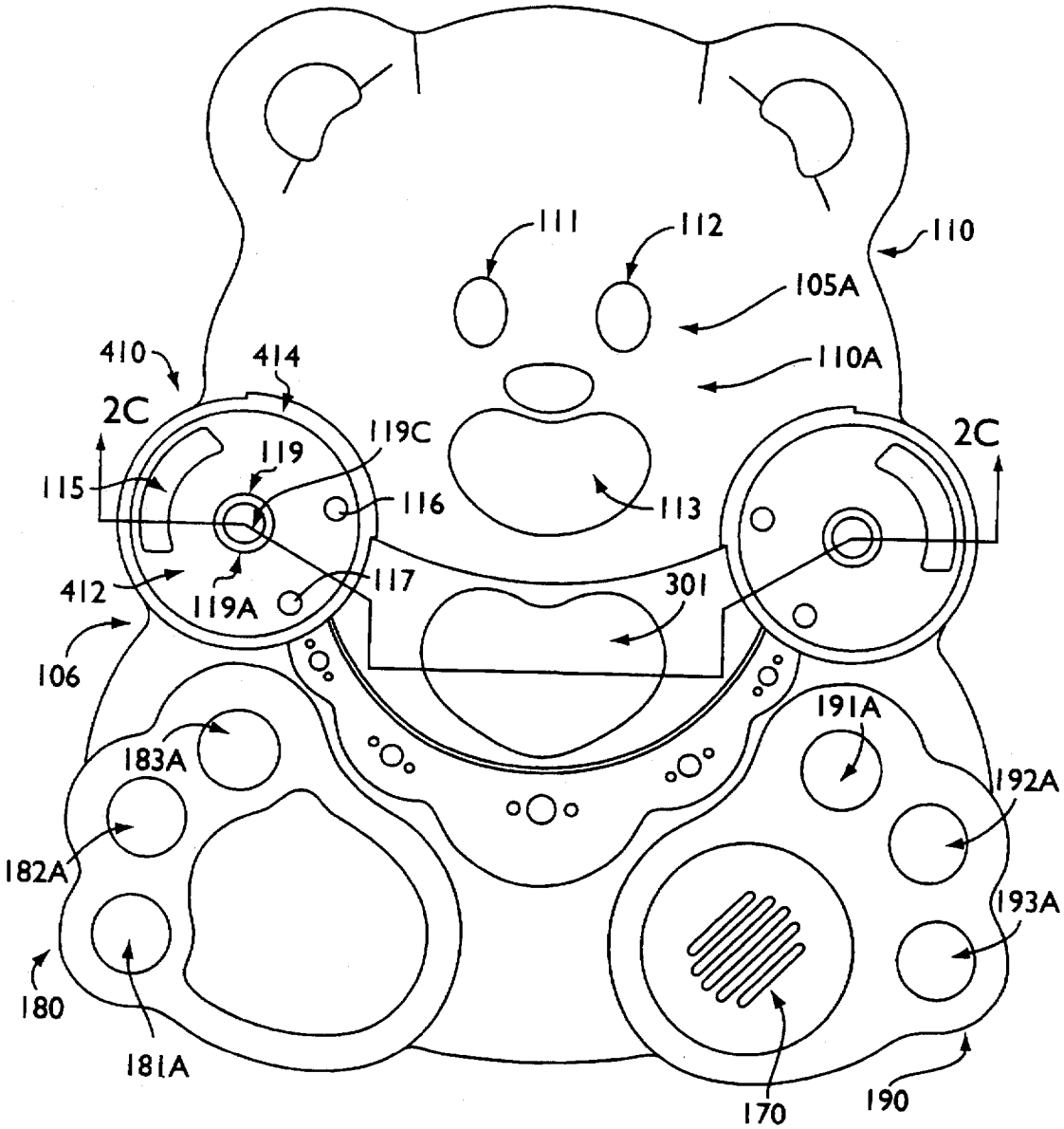
FIGS. 2A–2B are front and rear views of the front housing of the toy of FIG. 1.
Figure 2B:
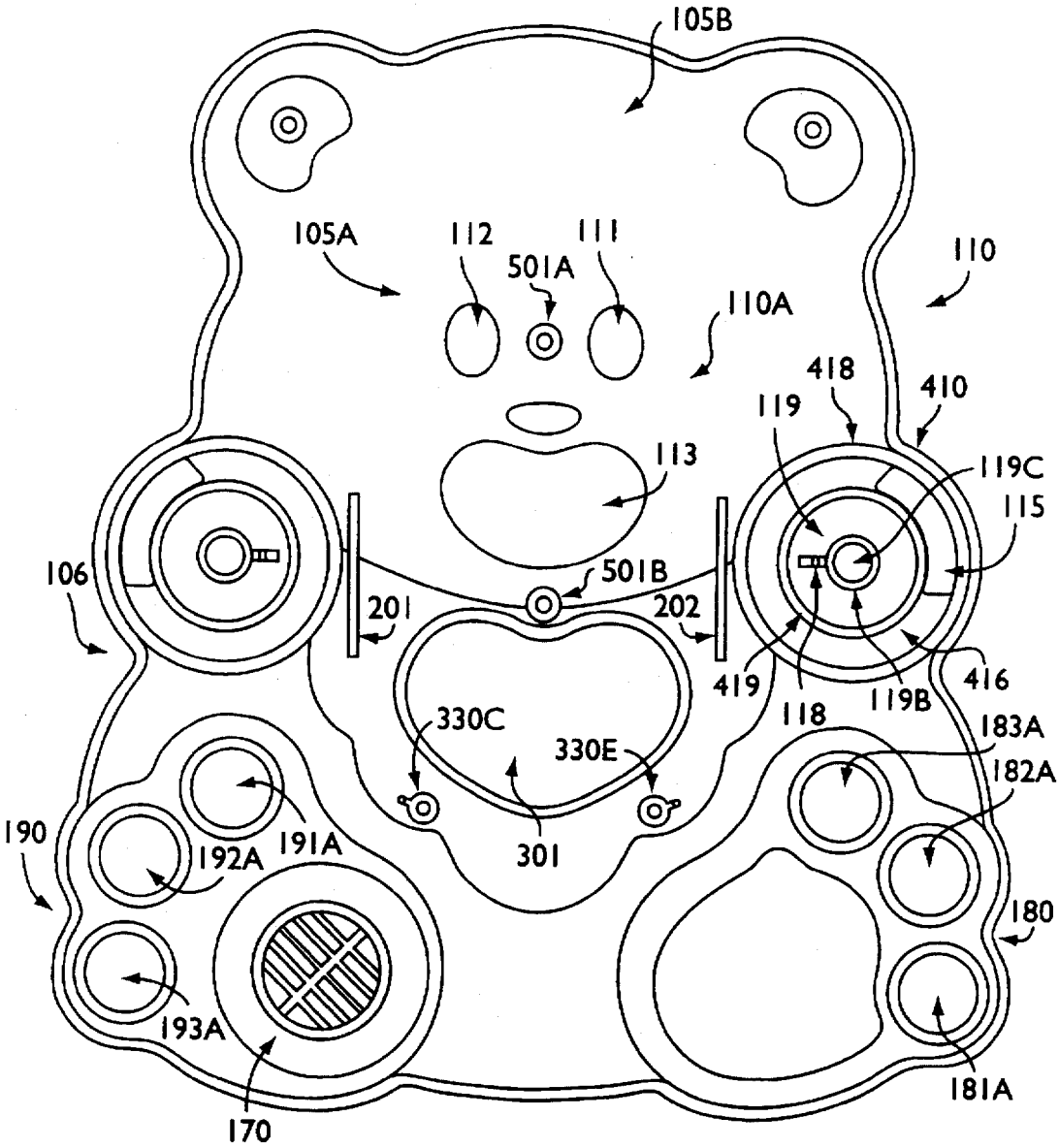
Figure 2C:
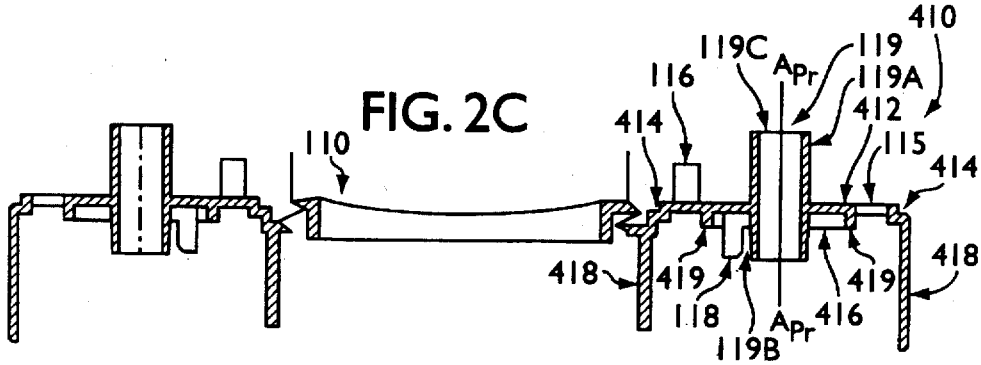
FIG. 2C is a cross-sectional view of the housing of FIG. 2A, taken along line 2C—2C.

Right paw assembly 400 is mounted for rotation to right paw boss 410 of front housing 110. As best seen in FIGS. 2A–C, right paw boss 410 has a flat, circular front mounting surface 412 on its front side, bounded at its periphery by a shoulder 414, and a circular rear mounting surface 416 on its rear side bounded at its periphery by a wall 418. A cylindrical right paw journal 119 is located in the center of paw boss 410, and has an outer portion 119A projecting outwardly from front mounting surface 412, an inner portion 119B projecting inwardly from rear mounting surface 416, and a central bore 119C that defines a right paw rotational axis $A_{pr}$. First and second cylindrical stop posts 116 and 117 project outwardly from front mounting surface 412. A cylindrical rib 419 projects inwardly from rear mounting surface 416 and is disposed concentrically between inner portion 119B of paw journal 119 and peripheral wall 418. An angled spring-retaining rib 118, projecting inwardly from rear mounting surface 416 and radially inwardly toward lower portion 119B, serves as a bearing surface for U-shaped spring 401. An arcuate slot 115 is disposed between cylindrical rib 419 and peripheral wall 418.

Right paw 130 is mounted to front mounting surface 412 with center post 135 received in central bore 119C of right paw journal 119, peripheral skirt 134 engaging peripheral shoulder 414, spring-engaging rib 131 passing through arcuate slot 115, and stop rib 132 disposed between stop posts 116 and 117. The end of center post 135 extends beyond the inner-most end of inner portion 119B. The ends of arms 401A, 401B of spring 401 engage the sides of spring engaging rib 131 of paw 130 and bight 401C engages the radially outer surface of inner portion 119B of journal 119. Paw plate 140 is mounted to rear mounting surface 416, with central aperture 143 disposed on the end of center post 135 of paw 130, spring engaging rib 141 disposed between arms 401A, 401B of spring 401 and radially between inner portion 119B and spring engaging rib 131, and actuating post 142 extending inwardly.

Paw 130 and paw plate 140 are thus coupled via spring 401 to rotate together as paw assembly 400 about right paw rotation axis $A_{pr}$. Paw assembly 400 can rotate through an angular range of motion bounded at one end by the first paw position in which obscuring portion 136 partially obscures viewing window 110A and at the other end by the second paw position. These limits on the range of motion are defined by the engagement of stop rib 132 with stop posts 116, 117.

Since paw 130 and paw plate 140 are not coupled directly to each other but rather are coupled via spring 401, the spring serves as a clutch mechanism to permit some relative rotation of the two parts. Thus, if oppositely directed rotative forces are applied to paw 130 and to actuating post 142 of paw plate 140, ends 401A and 401B of U-shaped spring 401 will be forced away from each other, against their normal bias, by opposite rotative movement of spring engaging rib 131 and 141 (of paw 130 and paw plate 140, respectively). This clutching action reduces the risk that the paw assembly will be damaged by application of external force to the paw, such as by a child pulling on the paw.

The visual and audible emotional expression assembly 900 includes a face disk 500, a viewing window plate 700, and an audio circuit 600.

Face disk 500 is illustrated in FIGS. 10A–D. Face disk 500 has a circular, dish-shaped body 520, with a concave rear surface 540 and a convex front surface 510. Post 502 projects rearwardly from the center of rear surface 540. Post 502 has a hollow, front portion 502A proximate to rear surface 540, ribbed, central portion 502B, and a tapered rear portion 502C. Front portion 502A has an inner bore 502D that opens forwardly to a central aperture 501 in the center of front surface 510. Central portion 502B is formed with three radially extending ratchet teeth 504, 505, 506 symmetrically spaced at 120° intervals. The radially outer end of each tooth is beveled. For purposes of reference herein, tooth 504 is considered to define a 0° angular position on face disk 500, with angular position increasing clockwise on face disk when viewed from its front side. Thus, tooth 505 is at angular position 120° and tooth 506 is at angular position 240°.

Face disk 500 includes four switch actuators 550, 560, 570, and 580, projecting rearwardly from rear surface 540. The switch actuators are formed as arcuate ribs, disposed at one of two radial distances $R_1$ and $R_2$ from the center of face disk 500—switch actuators 550 and 580 are positioned at distance $R_1$, while actuators 560 and 570 are at $R_2$. Each actuator has a beveled front camming surface (beveled in the direction in which face disk 500 is rotated in operation) that ramps back to a first upper rear surface, a step-down to a second lower rear surface, and a rear camming surface. For example, actuator 550 has a front camming surface 551, a first upper rear surface 552, a step-down to a second lower rear surface 553, and a rear camming surface 554. The switch actuators are distributed about face disk 500 at three angular positions (defined by the edge of the lower surface opposite to the camming surface): actuator 550 is positioned at 60% actuators 570 and 580 are at 180°, and actuator 560 is at 300°.

Front surface 510 bears three sets of surface graphics or visual indicia, with each set including representations of two eyes and a mouth. Each of the sets is configured to visually represent or indicate a different emotional state. In each set, the mouth extends radially from near the outer edge of face disk 500, while the eyes are spaced symmetrically about the center of face disk 500 along a line perpendicular to a radial line extending from the mouth through the center of the disk. The three sets of indicia are distributed about front surface 510 at three angular positions, defined by the center line of the mouth. First set 511 includes mouth 512 and eyes 513, is positioned at 120°, and represents a sleepy state. Second set 514 includes mouth 515 and eyes 516, is positioned at 240°, and represents a happy state. Third set 517 includes mouth 518 and eyes 519, is positioned at 0°, and represents a sad state.

Figure 3A:
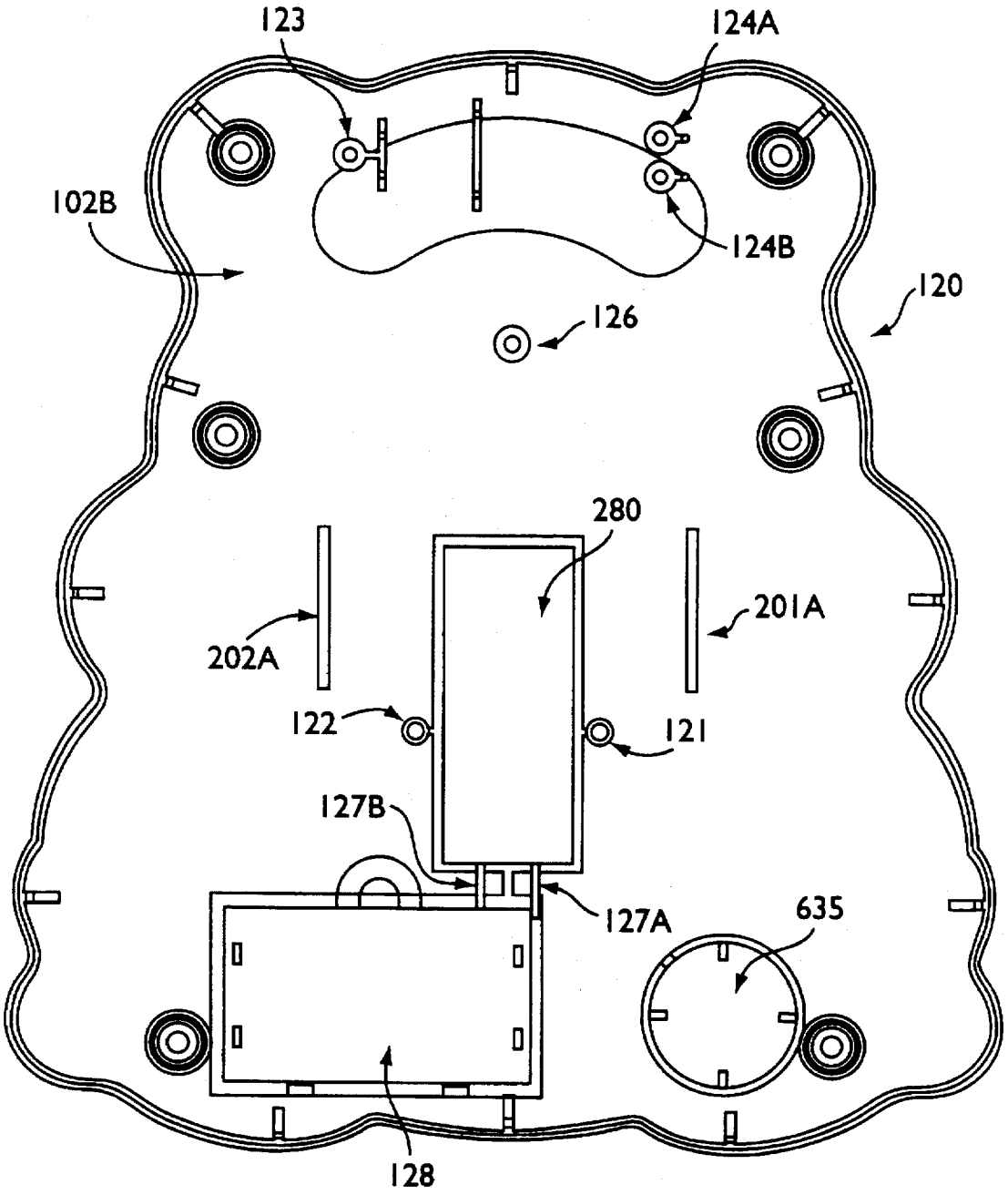
FIGS. 3A–3B are front and rear views of the rear housing of the toy of FIG. 1.
Figure 3B:
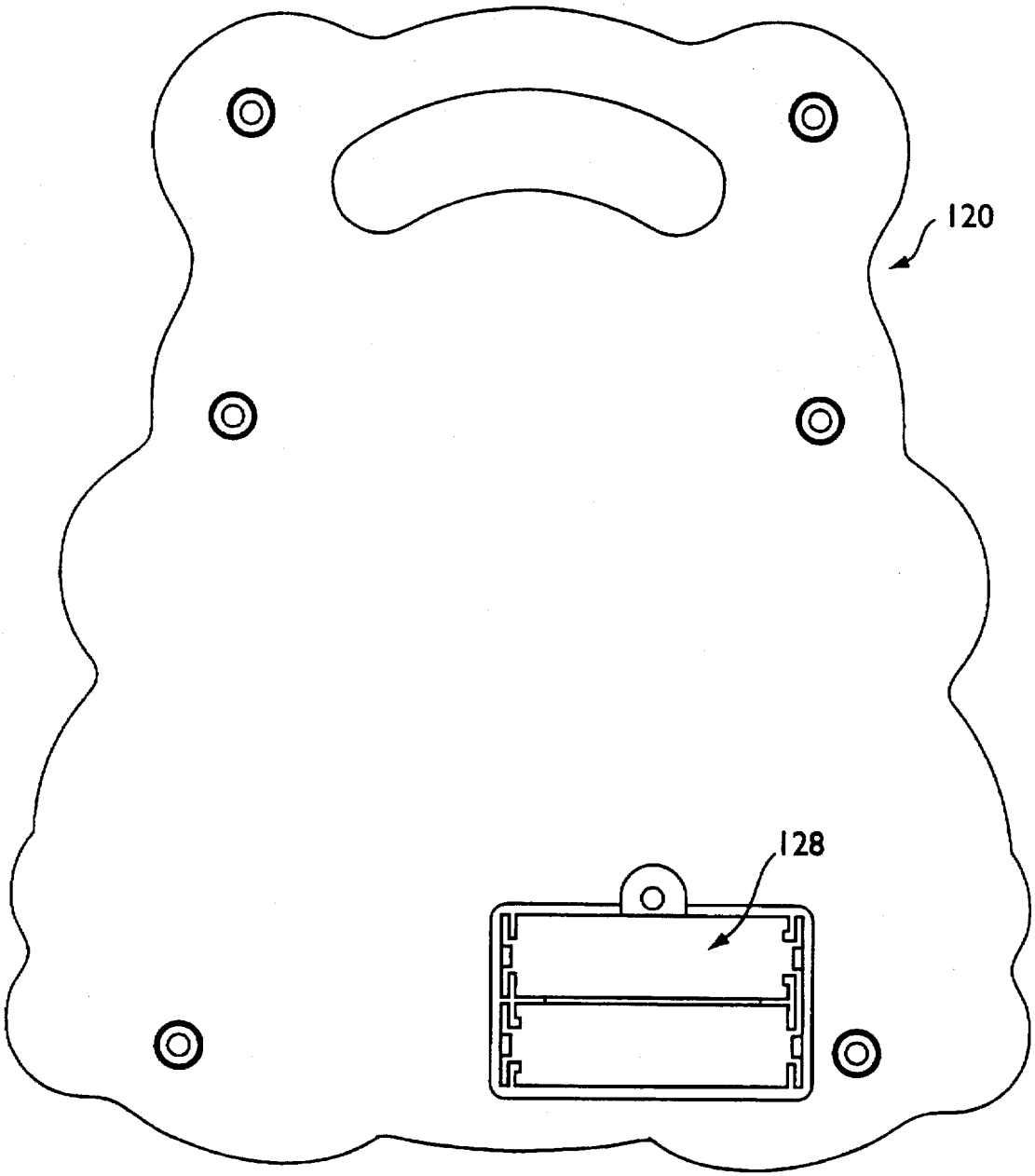
Figure 4A:
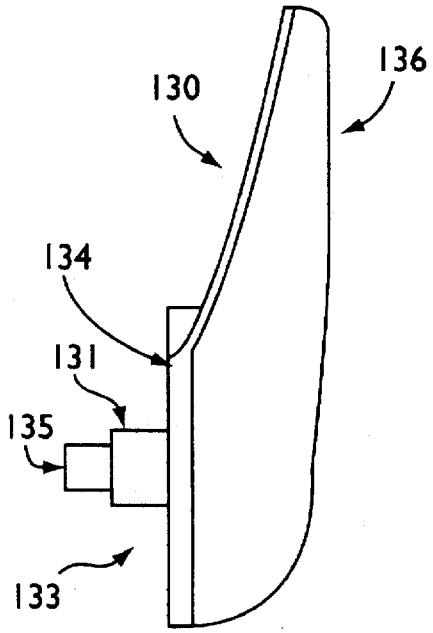
FIGS. 4A–4D are left, right, front, and rear views, respectively, of the right paw of the toy of FIG. 1.
Figure 4B:
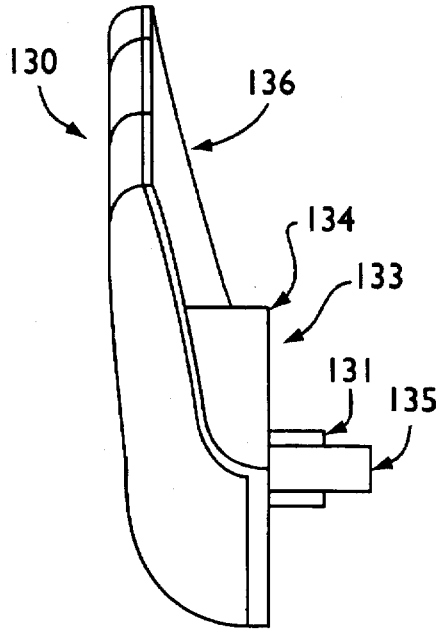
Figure 4C:
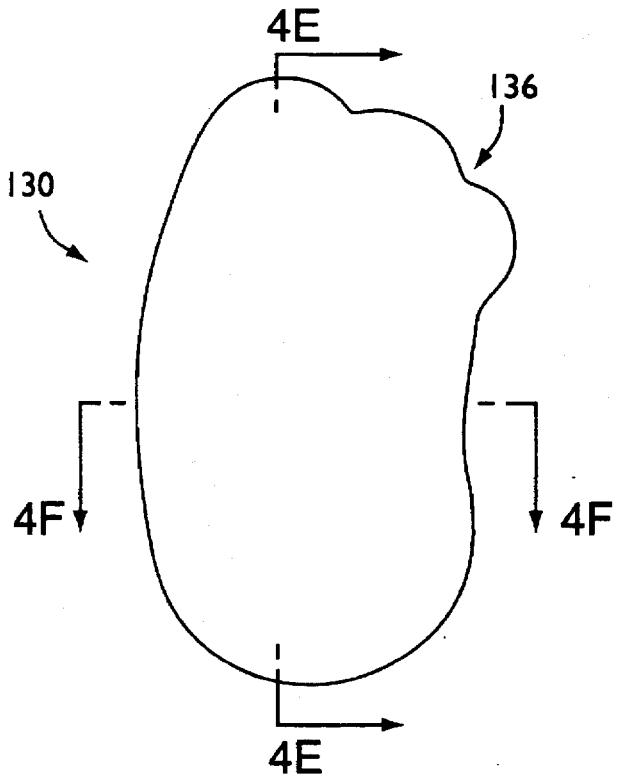
Figure 4D:
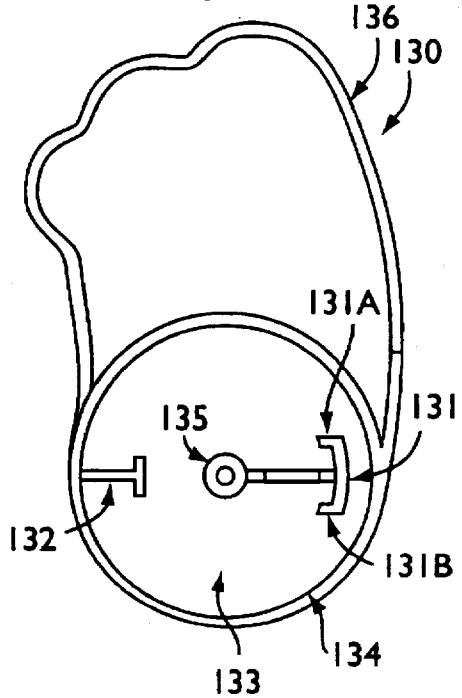
Figure 4E:
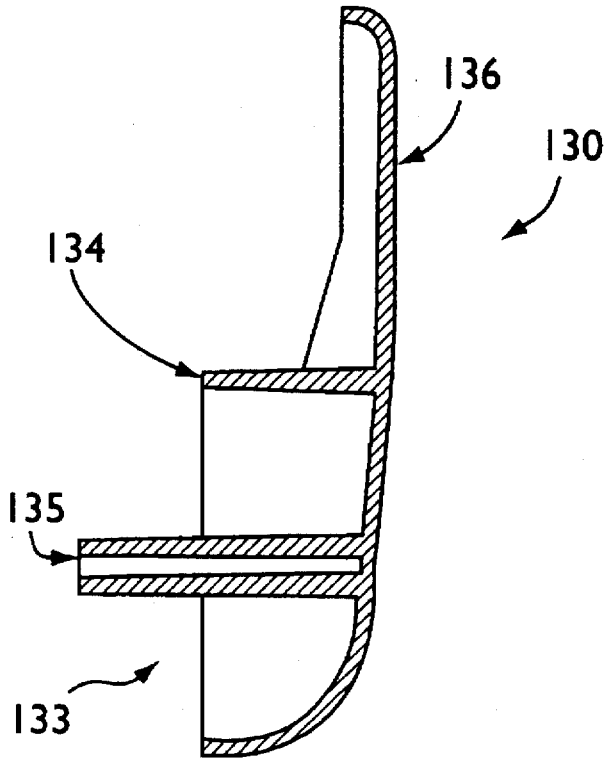
FIGS. 4E and 4F are cross-sectional views of the right paw taken along lines 4E—4E and 4F—4F of FIG. 4C, respectively.
Figure 4F:
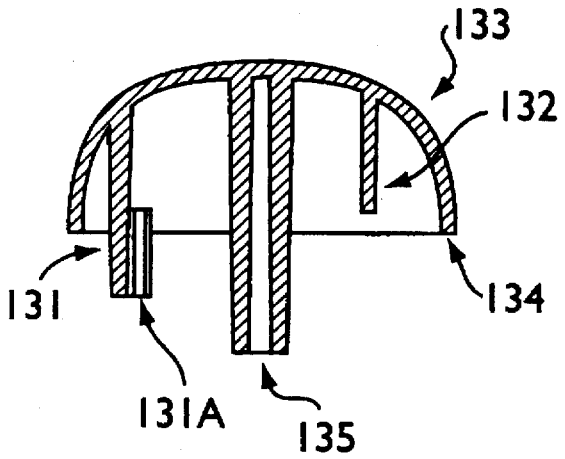
Figure 5A:
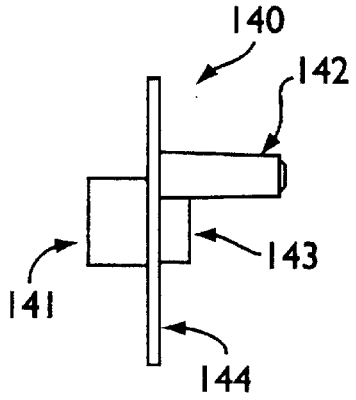
FIGS. 5A–5D are right, rear, left, and front views, respectively, of the right paw plate of the toy of FIG. 1.
Figure 5B:
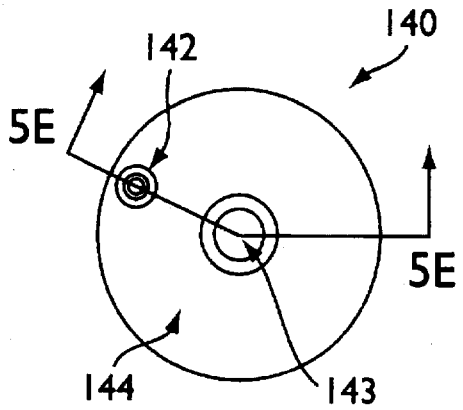
Figure 5C:
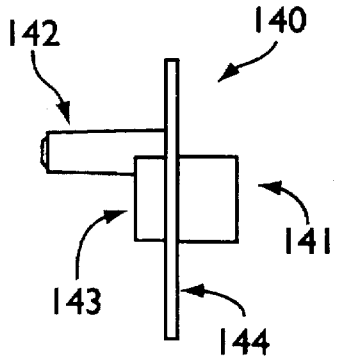
Figure 5D:
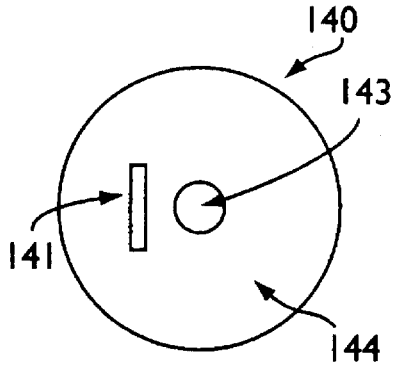
Figure 5E:
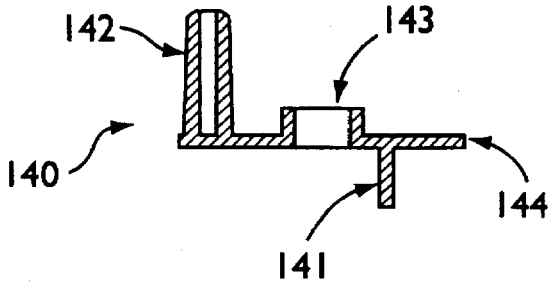
FIG. 5E is a cross-sectional view of the right paw plate taken along line 5E—5E of FIG. 5B.
Figure 6A:
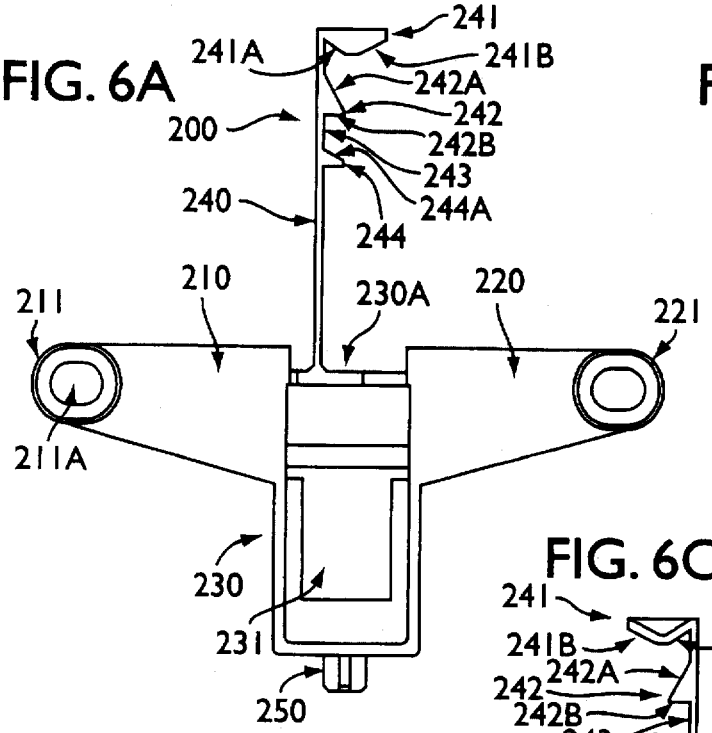
FIGS. 6A–6E are front, right side, rear, top, and bottom views of the indexer of the toy of FIG. 1.
Figure 6B:
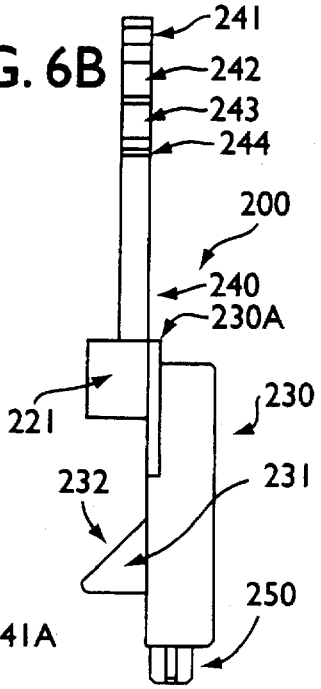
Figure 6C:
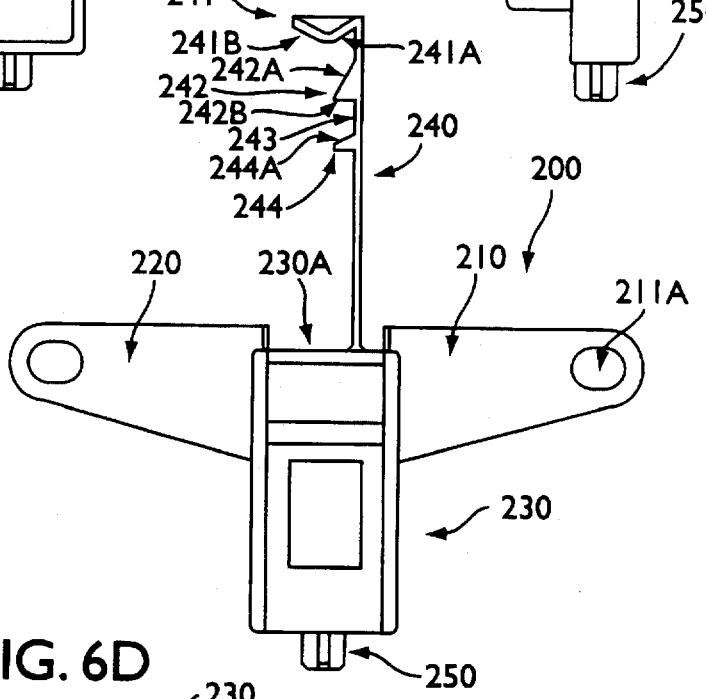
Figure 6D:
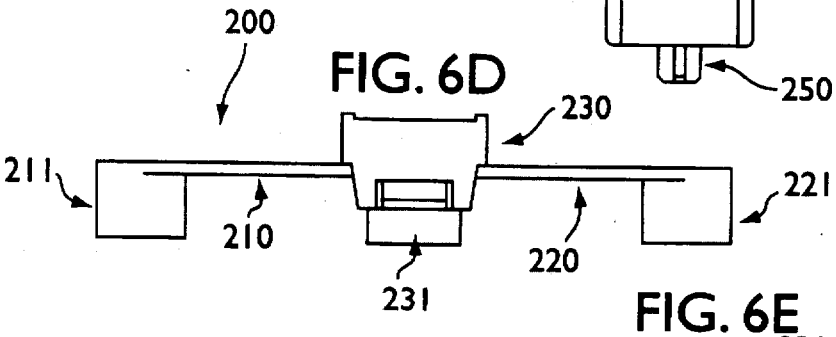
Figure 6E:
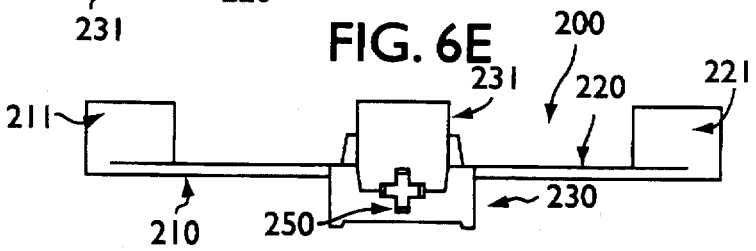

Face disk 500 is mounted in face portion 105 of body 102. As shown in FIG. 3A, face portion 102B of rear housing 120 has a hollow, cylindrical face disk mounting boss 126 projecting forwardly from its front surface. As shown in FIGS. 2A–B, face portion 105A of front housing 110 includes eye openings 111, 112, and mouth opening 113. Upper and lower hollow cylindrical mounting bosses 501A and 501B project rearwardly from inner surface 105B of face portion 105A and are disposed on the housing's centerline, with the upper boss disposed between eye openings 111, 112 and the lower boss disposed below mouth opening 113.

Figure 11A:
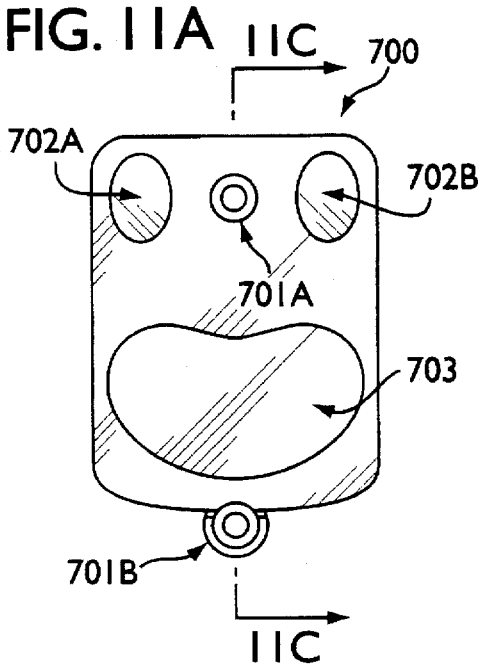
FIGS. 11A–B are front and side views, respectively, of the face plate of the toy of FIG. 1.
Figure 11B:
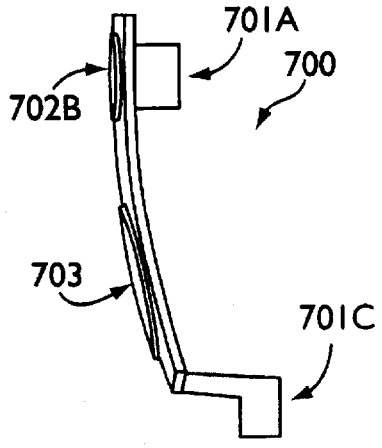
Figure 11C:
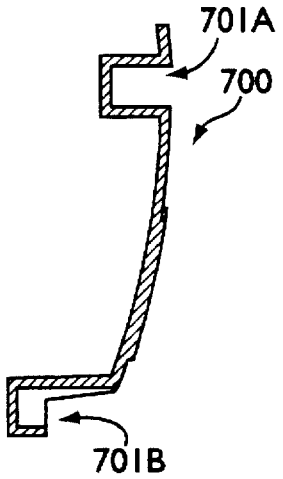
FIG. 11C is a cross-sectional view of the face plate taken along line 11C—11C of FIG. 11A.

A transparent face plate 700 is mounted to face portion 105A to cover eye openings 111, 112 and mouth opening 113. As shown in FIGS. 11A–11C, face plate 700 is a generally rectangular, slightly arcuate plate, with upper and lower mounting bosses 701A, 701B, projecting rearwardly from its rear surface, right and left eye portions 702A and 702B, respectively, and mouth portion 703, projecting slightly forwardly from its front surface. Face plate 700 is mounted to front housing 110 with the face plate's upper and lower mounting bosses disposed on the housing's upper and lower mounting bosses 501A and 501B, and held in place with screws or other appropriate fasteners passing through the bores of the plate's bosses and engaging the bores of the housing's bosses. Eye portions 702A, 702B are disposed in eye openings 111, 112, and mouth portion 703 is disposed in mouth opening 113, the front surfaces of the eye and mouth portions lying substantially flush with the inner surface 105B of face portion 105A. Face plate 700 thus prevents entry of objects into the housing via the eye and mouth openings.

Face disk 500 is mounted within face portion 105 by mounting rear portion 502C of post 502 in face disk mounting boss 126 of rear housing 120, and mounting inner bore 502D of front portion 502A of post 502 onto upper mounting boss 701A of face plate 700. Face disk 500 can rotate about these mounting points between first, second, and third rotative positions in which the first, second, and third sets of visual idicia 511, 514, and 517, respectively, are displayed in the viewing window collectively defined by eye openings 111, 112, and mouth opening 113.

Audio circuit 600 generates audible output including first, second and third audible expressions that are associated with the first, second and third visual indicia 511, 514, 517 (sleepy, happy, and sad). The circuit includes electrical contacts that are actuated by face disk 500 to initiate output of the audible expressions.

Figure 19:
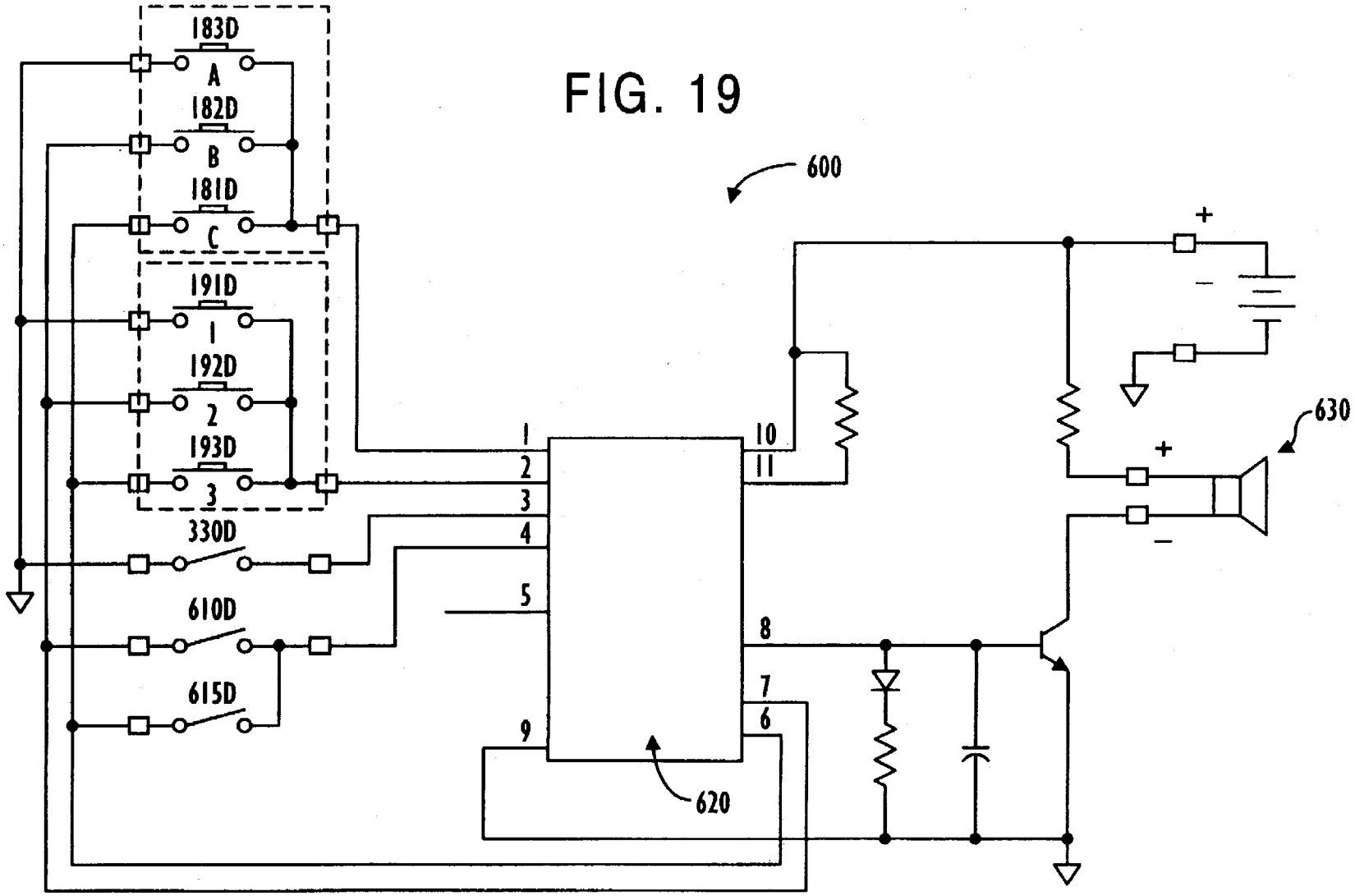
FIG. 19 is a schematic illustration of the audio circuit of the toy of FIG. 1.

Audio circuit 600 is illustrated schematically in FIG. 19. It includes a speech processor, which is powered by a power supply, receives control inputs from various input switches, and generates audio output via a speaker. Speech chip 620 may be any suitable integrated circuit or other device that is capable of generating human speech and sound effect output in response to control inputs and driving an audio speaker. In the illustrated embodiment, the speech chip is model number W52832_D, available from the Windbond Company. Three audible expressions, representative of the three emotional states, sleepy, happy, and sad, are stored in the chip for output when the appropriate control inputs are received. Speech chip 620 is powered by standard dry cell batteries, and provides output to a conventional, low cost magnetic voice coil speaker 630. Control inputs are received from first and second face disk switches 610D and 615D, associated with face disk contacts 610, 615, from heart switch 330D, number switches 191D, 192D, 193D, and letter switches 181D, 182D, and 183D. Speech chip 620 is mounted on a printed circuit board disposed within right foot 180 of the bear. Batteries are disposed in a conventional covered battery compartment 128 formed in rear housing 120. Speaker 630 is mounted in speaker cavity 635 projecting forwardly from the inner surface of rear housing 120, and is disposed behind speaker grill 170 in front housing 110.

Figure 13A:
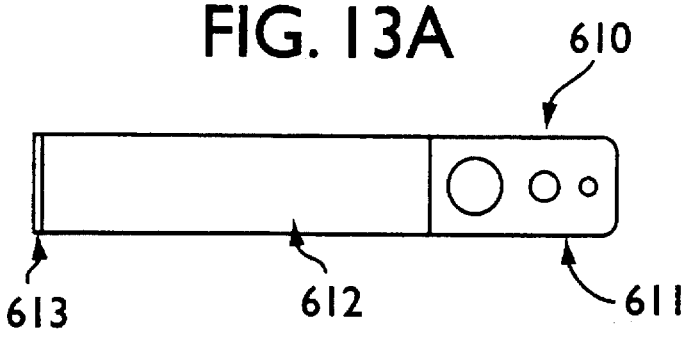
FIGS. 13A–B are top and front views of a face disk contact of the toy of FIG. 1.
Figure 13B:
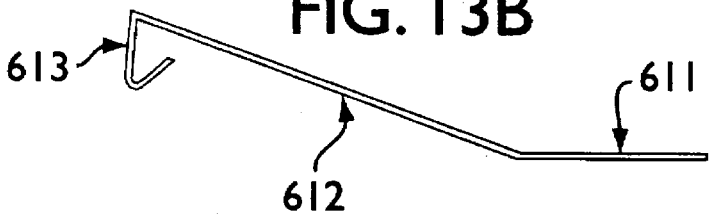
Figure 14A:
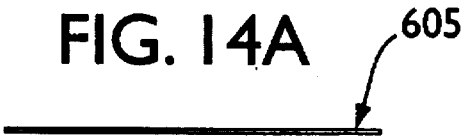
FIGS. 14A–B are top and front views of a common contact of the toy of FIG. 1.
Figure 14B:
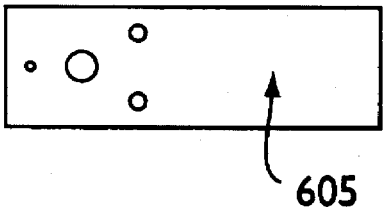

Switches 610D and 615D include first and second face disk contacts 610 and 615 and common contact 605. FIGS. 14A–B show common contact 605. Contact 605 is an elongated electrically conductive member. Contact 605 is mounted on common contact mounting post 123 and extends toward the center line of rear housing 120. As best seen in FIG. 13A–B, face disk contacts 610, 615 are identically-shaped strips of copper, formed in the shape of the number "7". With reference only to contact 610, the contact has a straight mounting portion 611, an angled arm portion 612, and a head portion 613. Face disk contacts 610, 615 are mounted to face disk contact mounting posts 124A, 124B, respectively, which extend toward the center line of rear housing 120. The common contact 605 is mounted disposed behind contacts 610, 615, respectively, and overlap across the center line of rear housing 120. Contacts 610, 615 are normally spaced from contact 605. Contacts 610, 615 are spaced from face disk mounting boss 126 of rear housing 120 by a distance equal to $R_1$ and $R_2$, respectively (defined with reference to face disk 500). Thus, face disk switch actuators 550, 560, 570, and 580, can selectively engage contacts 610, 615 and urge them into conductive engagement with contact 605. Switch actuators 550 and 580 are positioned at distance $R_1$ and therefore engage contact 615, while actuators 560 and 570 are at $R_2$ and therefore engage contact 610.

An internal actuating linkage, indexer 200, operatively interconnects with the right and left paw assemblies 400 and 470 to rotate the paw assemblies and with the visual and audible emotional expression assembly 900 to change the visible emotional expression displayed and the audible emotional expression generated. Indexer 200 is illustrated in FIGS. 6A–E.

Indexer 200 has a generally rectangular base portion 230, right and left paw rotating arms 210, 220 extending laterally from the sides of base 230, face disk rotating arm 240 extending upwardly from upper end 230A of base 230, cam portion 231 projecting forwardly from the front side of base 230, and compression spring 260 (not shown in FIGS. 6A–E) extending downwardly from spring mounting post 250, which extends from the lower end of base 230. Right paw rotating arm 210 has a right paw actuating boss 211 projecting outwardly from its front surface. Boss 211 has an oblong central bore 211A that corresponds in height to the outside diameter of paw plate actuating post 142, but which is substantially wider than the diameter of post 142. Left paw rotating arm 220 similarly has a left paw actuating boss 221.

Face disk rotating arm 240 is a slender, rectangular cross-section, flexible shaft with upper and lower pawl tabs 242 and 244 projecting from its right side, spaced by an intertab spacing 243, and a V-shaped face disk retainer tab 241 projecting to the right from its upper end. Upper and lower pawl tabs 242 and 244 are each triangular in plan view. Upper pawl tab 242 has a horizontal, downwardly facing ratchet-tooth engaging surface 242B, and lower pawl tab 244 has an upwardly- and rightwardly-facing camming surface 244A. Face disk retainer tab 241 has symmetrically-disposed downwardly facing ratchet tooth engaging surfaces 241A and 241B, subtending an angle of 120°.

Cam portion 231 is a wedge-shaped projection with an upwardly and forwardly facing camming surface 232 inclined at an angle of 45° with respect to base 230.

Indexer 200 is disposed within body 102 and is mounted for vertically translational motion. Rear housing 120 has a rectangular indexer mount 280 projecting inwardly from the inside surface of the rear housing. The vertically extending side portions of mount 280 are spaced to closely receive the sides of indexer base portion 230, while the upper and lower end portions are spaced by a distance equal to the length of base portion 230 plus an indexer translation distance $D_i$. Indexer 200 can thus slide up and down within indexer mount 280 over a distance $D_i$, guided by the side portions of mount 280. Indexer 200 is further guided, and is restrained from forward or backward movement, by left and right front housing ribs 201, 202 projecting rearwardly from the inside surface of front housing 110, and left and right rear housing ribs 201A, 202A projecting forwardly from the inside surface of rear housing 120. These ribs are spaced by a front-to-rear distance slightly greater than the thickness of right and left arms 210, 220.

Compression spring 260 is disposed with its upper end 261 engaging spring mounting post 250 and its lower end 262 engaging the upper face of battery compartment 128, restrained from lateral movement by spring guide ribs 127A, 127B extending downwardly from mount 280. Spring 260 thus biases indexer 200 upwardly to a first, rest position in which the upper end of base portion 230 engages the upper end of mount 280. Indexer 200 can be translated downwardly through a translation distance $D_i$ to a second, fully-actuated position.

Indexer 200 can be moved from its rest position through its translational distance $D_i$ to its fully-actuated position by an actuator, or heart button 300. As best shown in FIGS. 8A–8F, heart button 300 has heart-shaped body portion 301A with a front actuating surface 301B and a rear surface 301C, and a peripheral wall 310 extending from body portion 301A around the inner portion of body portion 301A. Extending from the lower end of peripheral wall 310 is a tab 315 with knob 315A. A U-shaped cam rib projects rearwardly from rear surface 301C and terminates in an angled camming surface 306A, which is angled at 45° with respect to body portion 301A and corresponds in angle and length with camming portion 231 of the indexer 200. Left and right hollow, cylindrical bosses 312, 313 project rearwardly from rear surface 301C.

Heart button 300 is mounted for front-to-rear translational motion within front housing 110 between a first, extended position and a second, depressed position. Heart button 300 is disposed in heart button aperture 301. In the button's extended position, the front surface of peripheral wall 310 engages the inner surface of front housing 110 so that the button cannot be pulled forwardly out of heart button aperture 301. Heart button 300 is mounted with bosses 312, 313 disposed on left and right heart button mounting posts 121, 122 which project forwardly from the inside surface of rear housing 120 laterally outside indexer mount 280. The bosses and posts are slidingly engageable, and guide the heart button through its range of motion. Camming surface 306A is in sliding engagement with camming surface 232 of indexer 200. Heart button 300 is therefore biased into its extended position by the interaction of the camming surfaces 306A of the heart button 300 and the indexer camming surface 232. The heart button's extended and depressed positions therefore also correspond to the indexer's rest and fully-actuated positions.

To move the indexer 200 downwardly, rearward force is applied to actuating surface 301B of heart button 300, urging the heart button from its extended position toward its depressed position. As the heart button 300 moves rearwardly, the rearward motion of camming surface 306A urges indexer 200 downwardly against the force of spring 260 through interaction with camming surface 232 of indexer 200. Upon release of the force applied to actuating surface 301B, compression spring 260 urges indexer 200 upwardly toward its rest position. As indexer 200 begins its upward travel, camming surface 232 of indexer 200 and camming surface 306A of heart button 300 will again interact to return heart button 300 to extended position.

Indexer 200 operatively interacts with right and left paw assemblies 400 and 470 to rotate the paw assemblies. As indexer 200 moves downwardly, the translational motion of the indexer 200 will cause paw assembly 400 to rotate due to the engagement between post 142 of right paw plate 140 and actuating boss 211 in right arm 210 of the indexer 200. Since the left paw assembly is configured exactly as the right paw assembly and is interconnected with the indexer in the same manner as the right assembly, a discussion of the indexer interconnection with the left paw assembly is omitted.

Indexer 200 also operatively interacts with the visual and audible emotional expression assembly 900 to change the visible expressions displayed and to produce the audible outputs. Face disk rotating arm 240 of indexer 200 is in operative engagement with the face disk 500. Ribbed central portion 502B of the face disk post 502 is engaged by the face disk rotating arm 240 of the indexer 200 for rotational movement. When face disk 500 is in a first position where a first visual indicia is displayed through the eye and mouth openings of the bear's face, one of the ratchet teeth on the ribbed central portion 502B of face disk post 502 is oriented in a downward direction with the other two ratchet teeth facing upward. The upward facing ratchet tooth that is disposed on the side of post 502 facing face disk rotating arm 240 of indexer 200 rests within intertab spacing 243 in the rotating arm and is engaged on its lower side by the upper side 244A of lower pawl tab 244. In this engaged position, the face disk 500 is supported to prevent further unintended counter-clockwise rotation.

Figure 12A:
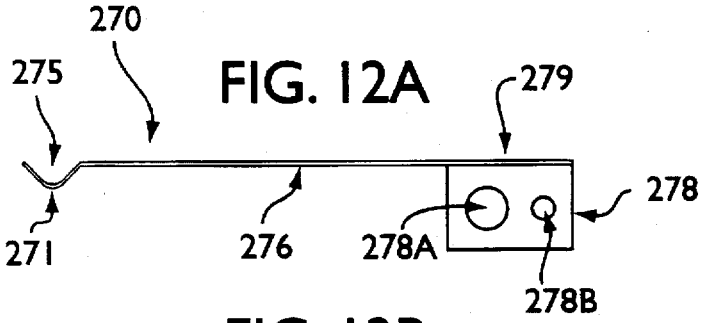
FIGS. 12A–C are front, top, and side views of a retaining spring of the toy of FIG. 1.
Figure 12B:
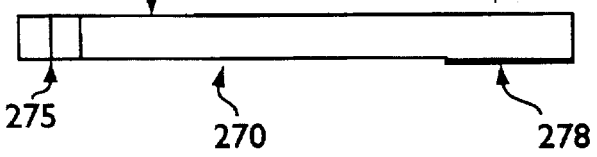
Figure 12C:
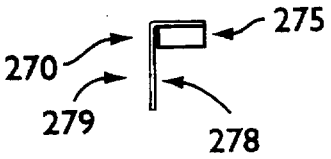

Undesired rotation of face disk 500 is also inhibited by retaining spring 270. As illustrated in FIGS. 12A–C, retaining spring 270 is an elongated strip of spring metal, with a flexible body portion 276 and a free end portion 275 that includes a V-shaped, downwardly-facing projection 271. Mounting end 279 of the spring has a tab 278 depending downwardly from its front edge and having apertures 278A, 278B for mounting on the inside surface of rear housing 120. Spring 270 is thus fixed to rear housing 120 as a cantilever, with its free end portion 275 adjacent ribbed central portion 502B of the face disk post 502. Projection 271 thus rests in the 120 degree opening between the two upwardly extending radial ratchet teeth of post 502 to further support the face disk 500 against unintended rotation. When post 502 is rotated due to operation of the toy, the rotational force applied to the radial ratchet teeth is sufficient to permit the projection 271 in the spring 270 to ride up over the radial ratchet tooth while the tooth is rotating. Upon completion of the rotation, the projection 271 will again rest in the 120 degree spacing between the two recently rotated upwardly extending radial ratchet teeth.

To achieve rotation of the face disk 500, when the indexer 200 is translated in a downward direction, upper pawl tab 242 on face disk rotating arm 240 of indexer 200 engages the upwardly extending radial ratchet tooth that is positioned adjacent to the rotating arm 240 and within intertab spacing 243 of the rotating arm. As the indexer 200 is moved downward, the lower engagement surface 242B of upper pawl tab 242 engages the top side of the radial ratchet tooth that is positioned within spacing 243. The downward force applied by the lower engagement surface 242B to the radial tooth, rotates the tooth. When the indexer 200 is translated to its lowest position, the tooth will have fully rotated 120°, thus rotating the face disk 120°, which places the face disk in a second rotated position where a second visual indicia is displayed through the eye and mouth openings of the bear's face. When the indexer 200 is at its lowest position, the lower surfaces 241A, 241B of face disk retainer tab 241 are seated between the two upwardly extending radial teeth of the post 502. The retainer tab 241 prevents over-rotation of the post 502 should an excessive downward force be applied to the indexer and transferred to the post.

Figure 15:
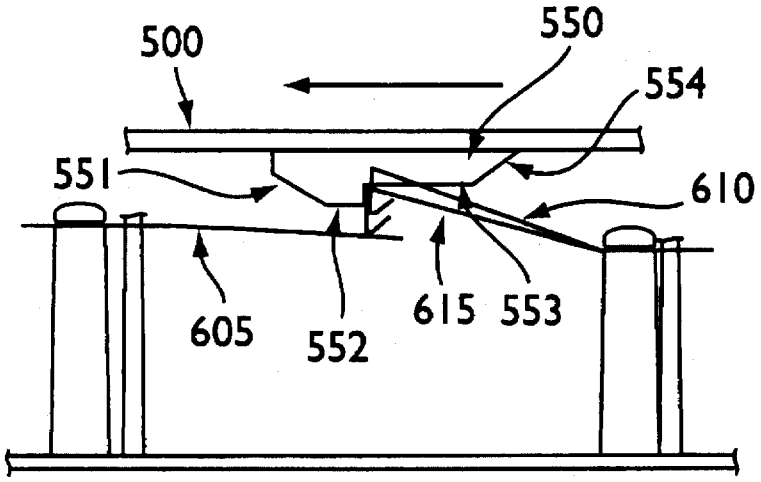
FIG. 15 is a partial cut-away top view of the face disk contacts, common contact, and switch actuator of the face disk of the toy of FIG. 1.

When the face disk 500 is rotated by the indexer 200 to present a particular visual indicia, the switch actuators on the rear side of the face disk operatively interact with the electrical contacts of the audio circuit to activate the appropriate audible expression. In order to close contacts 605 and 610, 615 to activate audio circuit 600, switch actuators 550, 560, 570 and 580 on the concave rear surface 540 of the face disk 500 engage face disk contacts 610, 615 to force the face disk contacts into engagement with the common contact 605 to activate the audio circuit 600. As the face disk 500 rotates to a position where a first visual indicia is displayed through eye openings 111, 112 and mouth opening 113, the corresponding switch actuators on rear surface 540 of the face disk 500 are also rotated. FIG. 15 illustrates the interaction of switch actuator 550 with face disk contacts 610, 615 and common contact 605. As the visual indicia is positioned within the eye and mouth openings, the front camming surface 551 of actuator 550 engages face disk contact 615. Face disk contact 615 travels over the first upper rear surface 552 of the actuator and steps down for seating against the second lower rear surface 553. In this position, face disk contact 615 engages common contact 605 to close switch 615D. Because the quantity and location of the actuators for each visual indicia are uniquely configured, when any particular visual indicia is displayed, the appropriate electrical contacts will be closed to activate the voice sequence that is correlated with the particular visual indicia displayed.

The rear camming surface of the actuators is provided for the situation where the heart button 300 is not depressed with enough force to fully rotate the face disk 500, and thus the face disk will return to its previous position. When the face disk 500 returns to its previous position, face disk contacts engage the rear camming surface of its associated actuator, the face disk contact will travel up the rear camming surface of the actuator and again seat against the second lower rear surface, reactivating the appropriate audio circuit. In this manner, even if the heart button 300 is depressed with insufficient force to fully rotate the face disk 500, an audio expression will still be heard that corresponds to the visual indicia displayed.

The indexer 200 returns to its uppermost position, after a complete 120° rotation of the face disk 500, due to the bias of compression spring 260. The face disk rotating arm 240, being constructed of a resilient material to permit flexing of the arm in a direction transverse to its longitudinal axis, will flex to allow upper pawl tab 242 to pass around the newly rotated upwardly extending radial tooth that is positioned adjacent to the rotating arm 240. The upper camming surface 242A of pawl tab 242 will permit tab 242 to pass around the radial tooth to return to its normally biased position above the radial tooth.

Figure 16A:
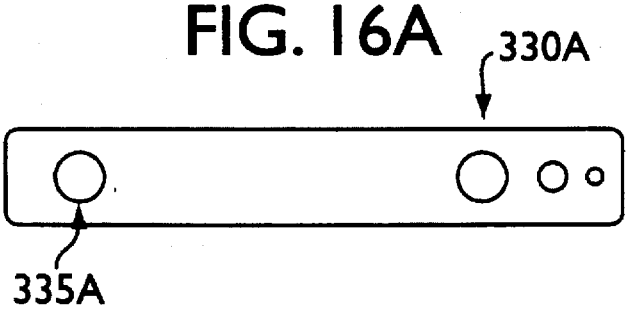
FIGS. 16A–B are top and front views of a heart contact of the toy of FIG. 1.
Figure 16B:
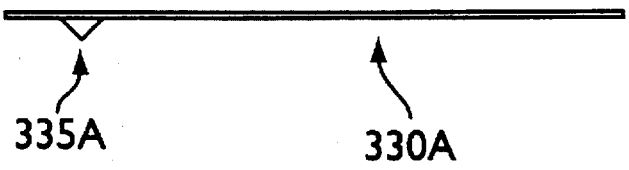

The toy also provides additional audio representations for the enjoyment of a child. A set of electrical contacts comprising switch 330D are associated with the heart button 300 such that when the heart button 300 is depressed into the bear, the contacts open to activate a speech sequence. Extending from the lower end of peripheral wall 310 of the heart button 300 is tab 315 with knob 315A extending therefrom. Knob 315A is in operative engagement with the set of electrical heart contacts 330A, 330B. Each electrical heart contact 330A, 330B is identically configured and is best seen in FIGS. 16A–B. Heart contact 330A is an elongated member of electrically conductive material that has a tip 335A. Heart contacts 330A, 330B are mounted inside the front housing 110 of the bear on posts 330C, 330E, respectively. The contacts are positioned such that the tips 335A, 335B oppose each other and are separated by a distance. When the heart button 300 is in its normally biased position extending outwardly from the bear, knob 315A of tab 315 of the heart button acts against the heart contacts 330A, 330B to force the tips 335A, 335B of the contacts into engagement. In this configuration, with the contacts and switch 330D closed, the audio circuit associated with the heart contacts is not activated. As the heart button 300 is depressed into the bear, tab 315 is also moved into the bear and knob 315A no longer acts against the heart contacts. With the heart button knob 315A no longer in operative engagement with the heart contacts, the contacts and switch 330D open, and a speech sequence is activated. The sequence that is played alternates each time switch 330D opens. The speech sequence alternates between saying "Let's play" and playing a musical tune each time switch 330D opens.

The heart contacts are electrically connected with the printed circuit board within right foot 180 and the speech sequence is programmed into the integrated circuit chip that was previously described.

The letter buttons 181, 182, 183 on the right foot 180, extending through apertures 181A, 182A, 183A, respectively, and number buttons 191, 192, 193 on the left foot 190, extending through apertures 191A, 192A, 193A, respectively, in the front housing 110, also provide audible speech representations. Buttons 181, 182 and 183 are located above the printed circuit board in right foot 180. Buttons 191, 192, 193 are located above a second printed circuit board that is electrically connected to the first circuit board and which is located within the housing of the bear under left foot 190 of the bear. As the buttons 181, 182, 183, 191,192, 193 are depressed, switches 181D, 182D, 183D, 191D, 192D, and 193D, associated with the buttons, close a circuit mounted on their respective printed circuit boards. When these contacts are closed, the associated speech sequence, programmed into the integrated circuit chip 620, is played.

An additional feature of the toy is also associated with right foot 180. Disposed on the outer surface of right foot 180 is a mirror 189. Mirror 189 allows a child to mimic the visual emotional expressions that are displayed on the bear and to see these mimicked expressions in mirror 189.

Figure 17A:
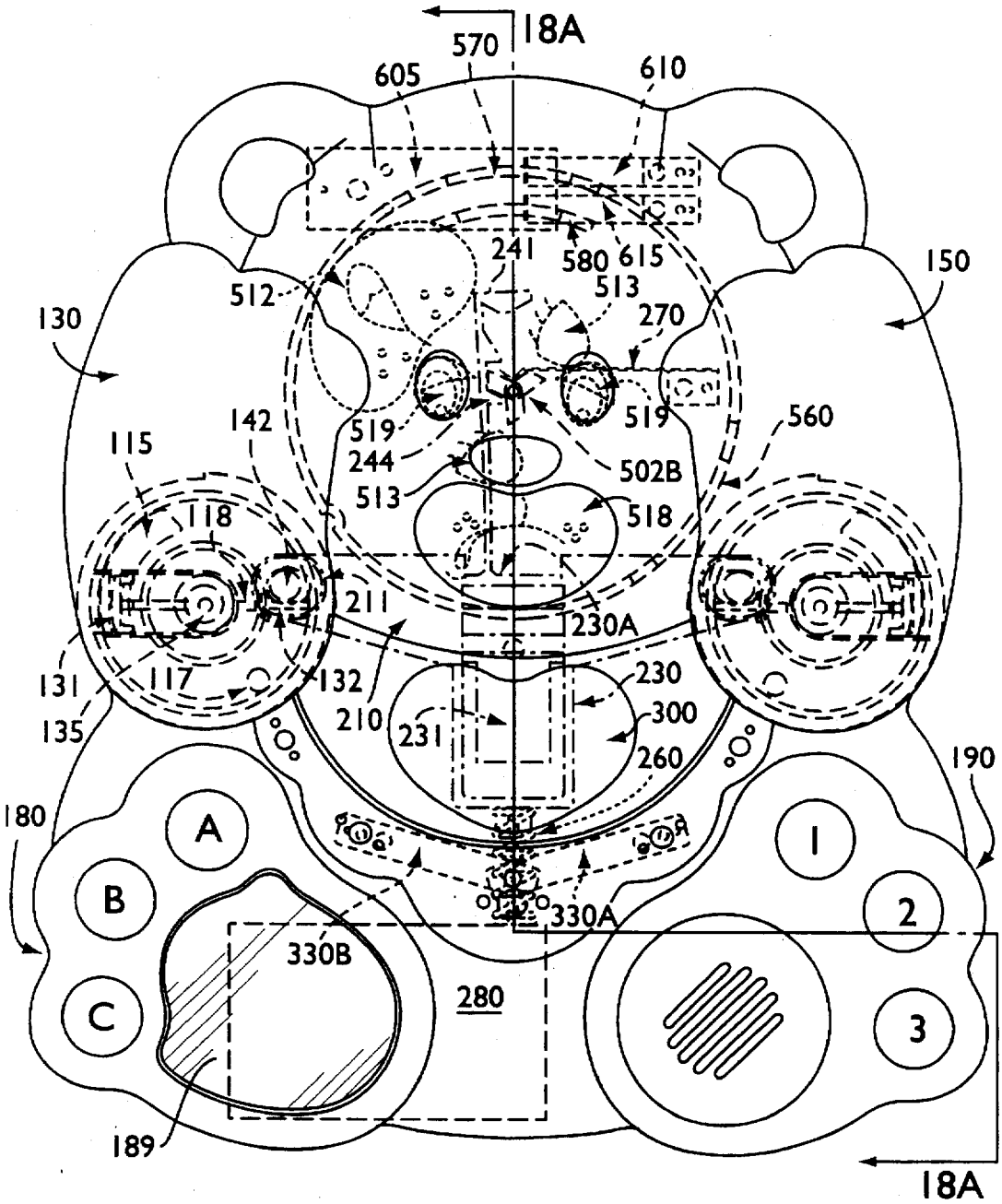
FIGS. 17A–C are front views of the toy of FIG. 1 illustrating the toy in several stages of its operating sequence.
Figure 17B:
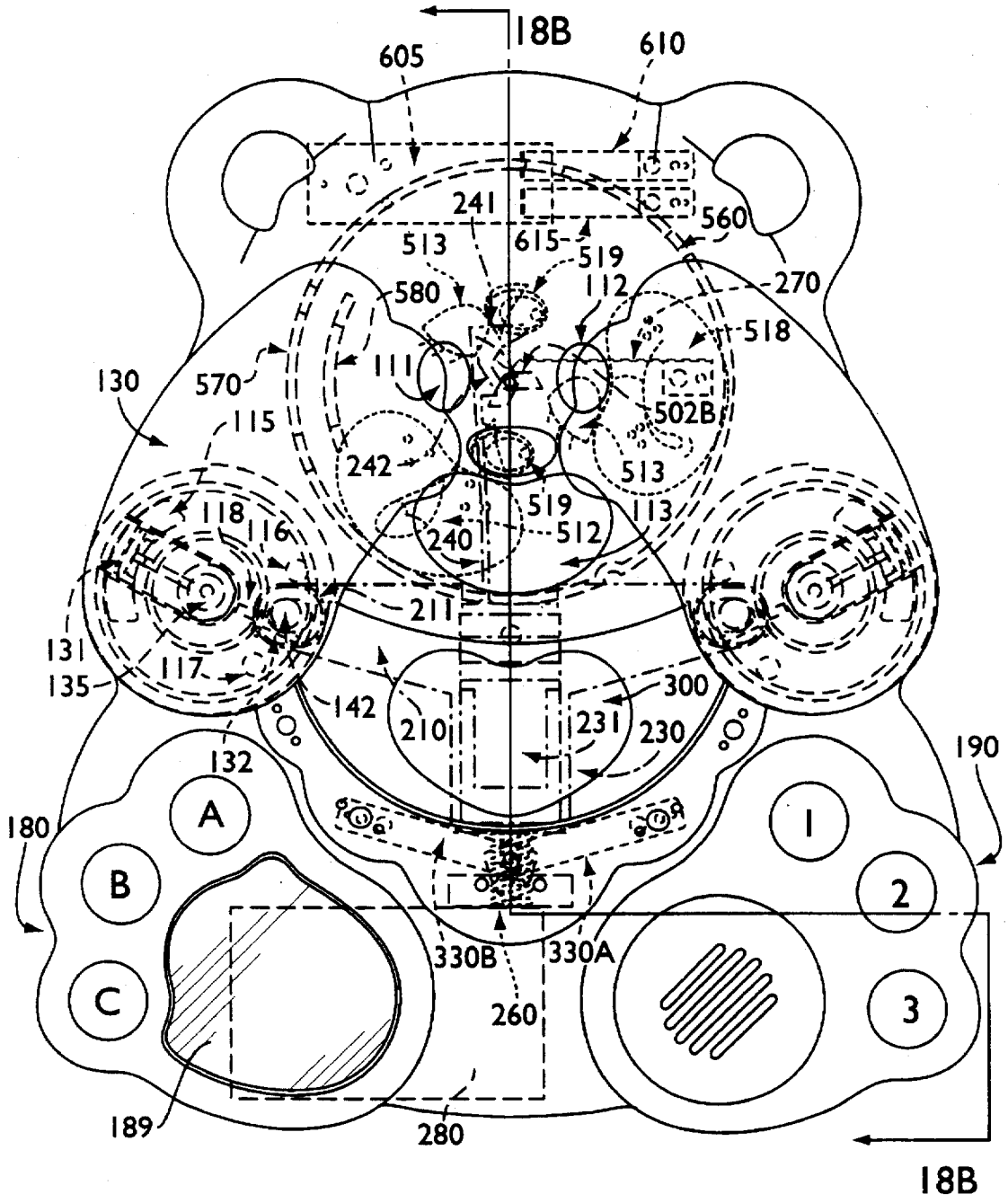
Figure 17C:
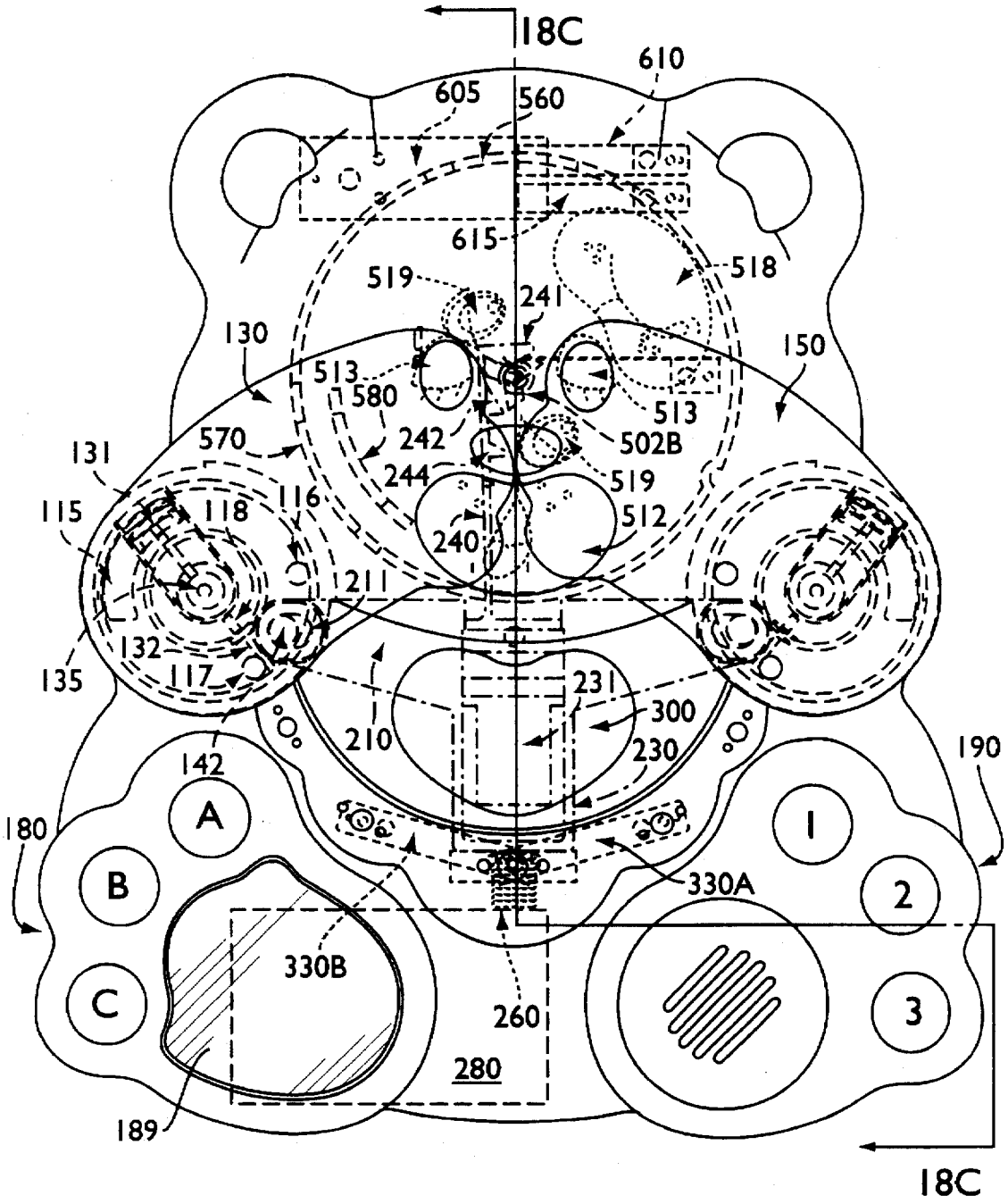
Figure 18A:
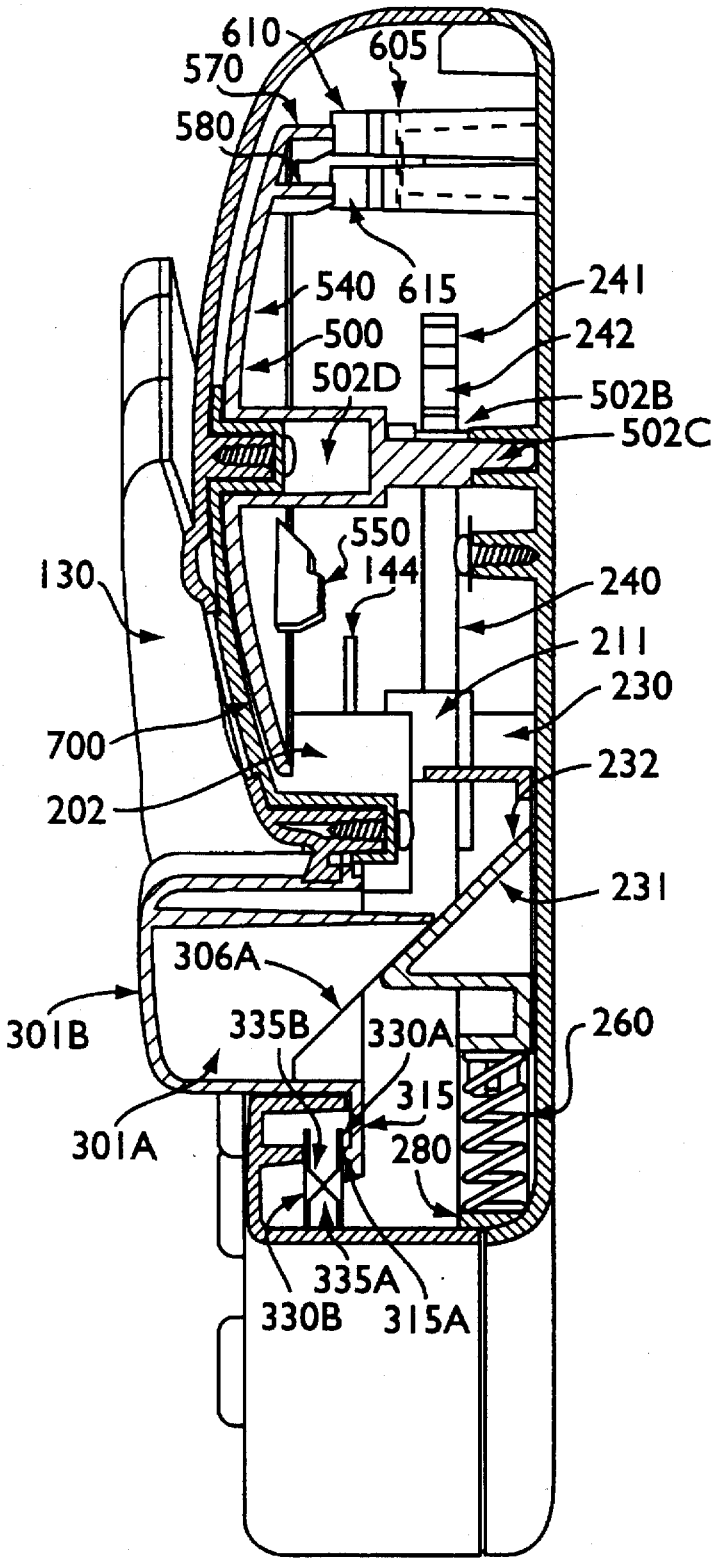
FIGS. 18A–C are cross-sectional views of the toy of FIG. 1 taken along lines 18A—18A, 18B—18B, and 18C—18C of FIGS. 17A–C, respectively.

The operating sequence of the toy is shown in FIGS. 17A–C and 18A–C. FIGS. 17A and 18A show the bear in the second position where the bear's paws 130, 150 are disposed away from the bear's face 105 which permits a viewer to observe a first visual indicia of emotional expression, which in FIG. 17A displays visual indicia 517, i.e. a "sad" expression. The mouth representation 518 and eyes representation 519 can be viewed through the mouth opening 113 and eye openings 111, 112, respectively, in the front housing of the bear 110. FIG. 18A shows heart button 300 is in its normal outwardly-biased position extending from the front housing 110 of the bear. The knob 315A of the heart button is in engagement with heart contacts 330, which brings the tips 335 of the heart contacts into engagement, thus deactivating the audio circuit that is associated with the heart button. Indexer 200 is biased into its upper most position by compression spring 260. The face disk rotating arm 240 of the indexer is in engagement with the ribbed central portion 502B of the post 502 of the face disk 500. Face disk switch actuators 570 and 580 are in engagement with face disk contacts 610, 615, forcing face disk contacts 610, 615 into engagement with common face disk contact 605. In this position, immediately after rotation of the face disk into this position, the electrical contacts activate audio circuit 600 to present a first audible emotional expression output, associated with the first visual indicia of emotional expression, which includes "I'm sad, Boo-hoo", the first bar of the melody "When You're Happy and You Know It", and "Boo-hoo."

Figure 18B:
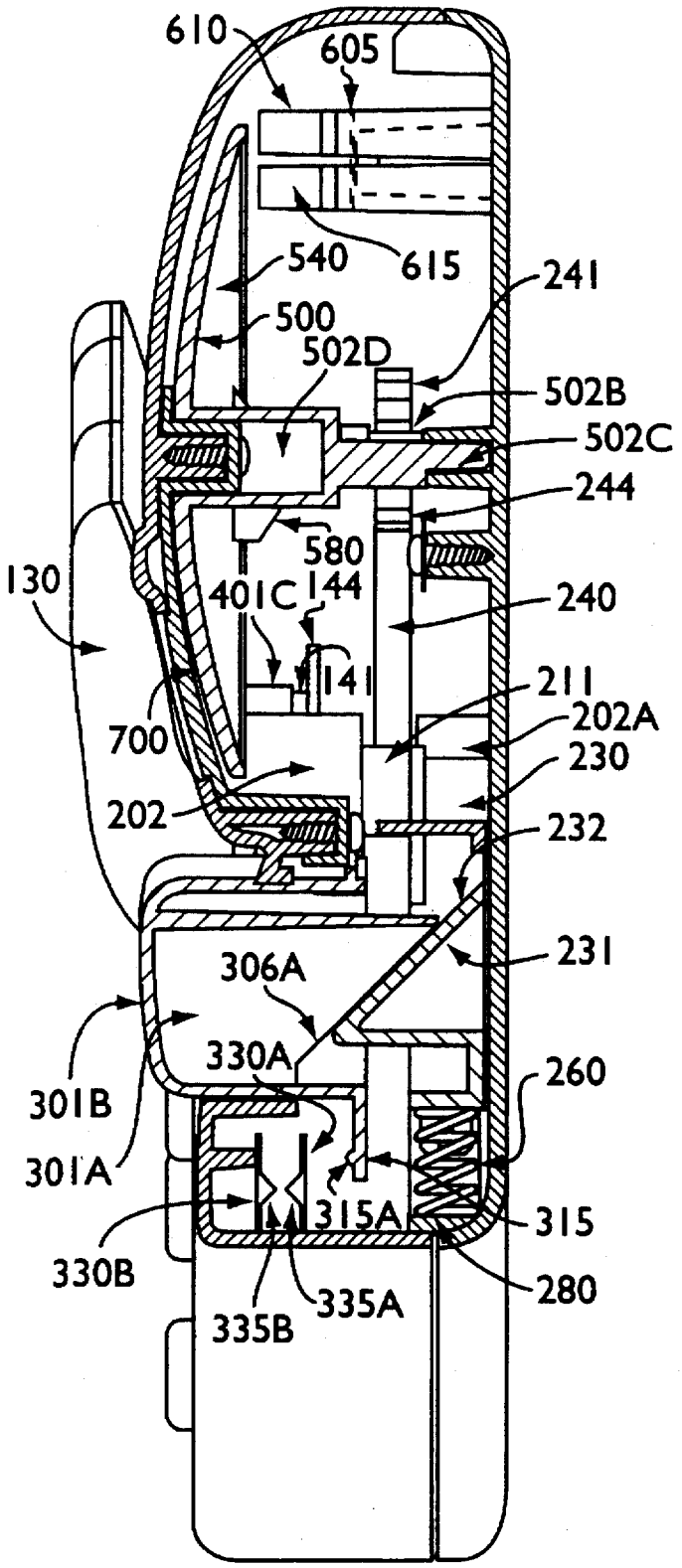

FIGS. 17B and 18B show the bear in transition from the second position, where the paws 130, 150 are disposed away from the bear's face 105, to a position where the paws are being rotated to the first position where, as will be shown, the paws will obscure the face of the bear so that the positioned visual indicia of emotional expression is not viewable. In FIG. 17B, the heart button 300 has begun to be depressed into the bear. As the heart button 300 begins its horizontal translational motion into the bear, camming surface 306A of the heart button 300 interacts with camming surface 232 of the indexer 200. This camming interaction forces indexer downward against the bias of compression spring 260. As the indexer 200 begins its downward motion, upper pawl tab 242, in engagement with ribbed central portion 502B of the face disk 500, begins to rotate the face disk to a second position where a second visual indicia of emotional expression will be positioned for viewing in the viewing window 110A of the bear and a second audible emotional expression output, associated with the first visual indicia of emotional expression, will be played.

FIGS. 17B and 18B further show that heart button knob 315A is now no longer engaging heart contacts 330A, 330B, which allows tips 335A, 335B of the heart contacts to disengage, thus activating the audio circuit that is associated with the heart button to play the alternating speech sequence. Indexer 200, in operative engagement with paw assembly 400, rotates the paw assembly so that the paws 130, 150 begin to rotate into a position in front of the bear's face.

As is shown, face disk switch actuators 570, 580 have begun their rotation and are no longer in engagement with face disk contacts 610, 615, thus, face disk contacts 610, 615 and common face disk contact 605 are no longer in electrical connection. Thereby, the audio circuit 600 is not activated.

Figure 18C:
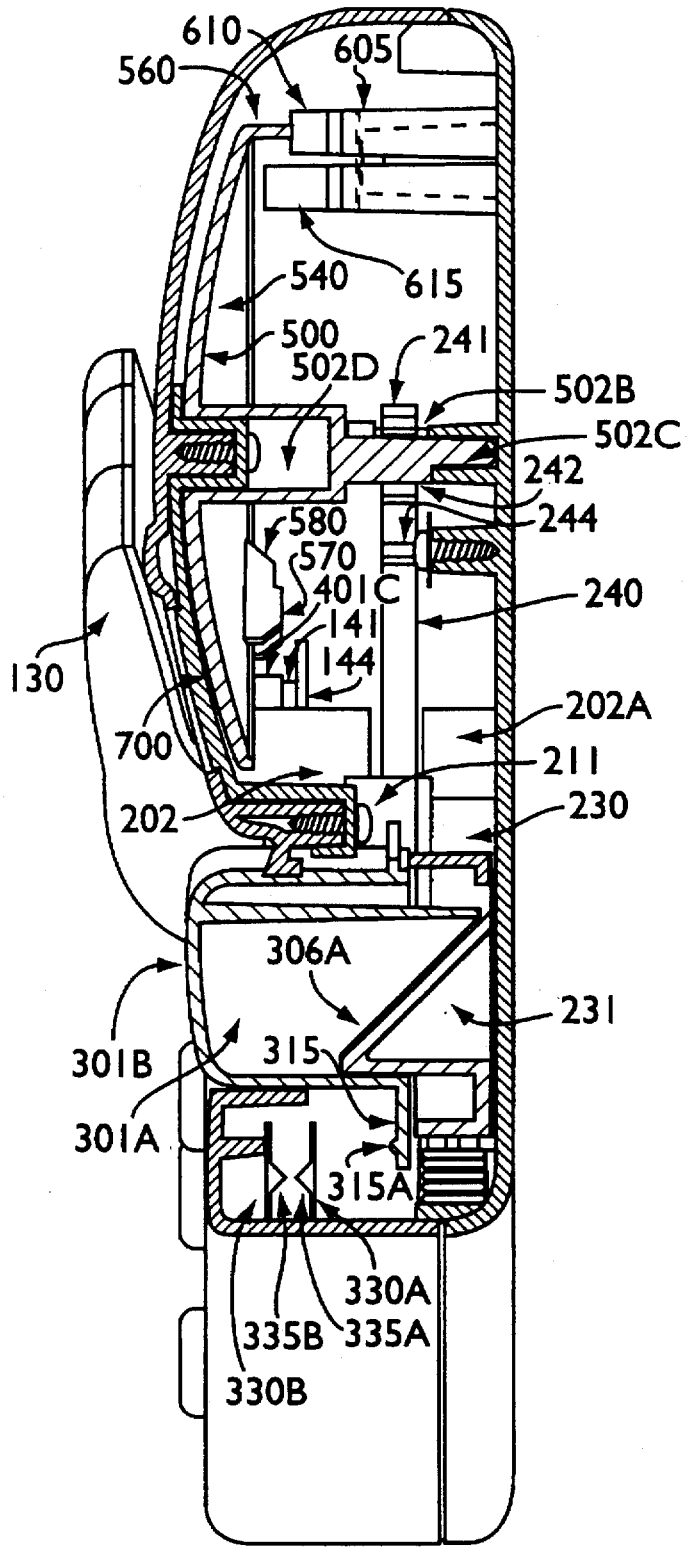

FIGS. 17C and 18C show the heart button 300 fully depressed into the bear. The indexer 200 is at its lowest point and the paws 130, 150 have been fully rotated into their first position where they obscure the face of the bear, thus preventing viewing of a visual emotional expression. The face disk 500, in operative engagement with the indexer 200, has also been rotated to a position where a second visual indicia of emotional expression can be viewed through the mouth opening 113 and eye openings 111, 112 of the bear. Whereas the paws are still obscuring the visual expression, they will immediately return to their second position, away from the face of the bear, when the force is removed that depressed the heart button 300 into the bear. This will permit the second visual indicia of emotional expression, 511, representative of the "sleepy" emotion, to be viewed in the face of the bear. As seen in FIG. 18C, switch actuator 560 is now in engagement with face disk contact 610, forcing face disk contact 610 into engagement with common face disk contact 605. The electrical contacts activate audio circuit 600 to present a second audible emotional expression output, associated with the second visual indicia of emotional expression, which includes "I'm sleepy, Night-Night", the first bar of the melody "When You're Happy and You Know It", and "Night-Night."

In this manner, a child is able to play a "peek-a-boo" game with a toy bear where a variety of associated visual and audible emotional expressions are presented in conjunction with the playing of the "peek-a-boo" game.

In the disclosed embodiment, all of the components are comprised of injection molded plastic. The front and rear housings, 110, 120, the paws 130, 150, and the face disk 500 are manufactured of styrene. The heart button 300 is comprised of polypropelene and the indexer 200 and paw plates are comprised of acetal. The indexer and paw plates are comprised of acetal in order to facilitate the movement of these parts. The toe buttons 181, 182, 183, 191, 192, 193 are comprised of propelene, the clear face plate 700 of clear styrene, and the springs 401, 260 of spring steel. It will be apparent to the artisan that other materials may be selected consistent with considerations of material and manufacturing cost, durability, and safety.

Several variations on the disclosed embodiment are contemplated. In the disclosed embodiment, heart button 300 is disclosed to actuate indexer 200, however, the invention is not limited to actuation by heart button 300. As disclosed, the paw assemblies are operationally connected with the indexer and thus, manual rotation of either paw by a child will actuate the toy. Additionally, although a mechanical actuator is described, an electrically driven actuator could be utilized without departing from the scope of the invention. Cost of manufacturing and durability are factors that would be considered in determining whether to implement an electrically operated actuator.

Although the head portion of the bear contains eye and mouth openings in the viewing window for observing the visual emotional expression, a single, large opening could be utilized. Additionally, whereas the face disk shows only eye and mouth representations in the disclosed embodiment, the entire face could be represented on the face disk.

The member for displaying the visual representations has been described as a face disk that rotates counter-clockwise about an axis extending from the front to the rear of the bear, however, the member could be configured in other geometric shapes and could be oriented for movement within the head of the bear along a variety of axes.

What is claimed is:

1. A toy comprising:

a housing having a viewing window formed therein;

an indicia-bearing member disposed within said housing and bearing a first visual indicium expressive of a first emotional state and a second visual indicium expressive of a second emotional state, said indicia bearing member being mounted for movement between a first position in which said first visual indicium is visible from outside said housing via said viewing window and a second position in which said second visual indicium is visible from outside said housing via said viewing window;

means for generating a first audible output expressive of said first emotional state when said indicia bearing member is in said first position and a second audible output expressive of said second emotional state when said indicia bearing member is in said second position.

2. The toy of claim 1 wherein:

said housing includes a face portion formed to emulate in appearance the face of a creature having emotions;

said first and second visual indicia include representations of a mouth of said creature in different expressive states; and said viewing window has a portion positioned to correspond to the location of the mouth on said face portion of said housing.

3. The toy of claim 1 wherein:

said first and second visual indicia include representations of two eyes of said creature in different expressive states; and said viewing window has a portion positioned to correspond to the location of the eyes on said face portion of said housing.

4. The toy of claim 1 wherein said first and second audible outputs are statements of emotional state expressed in spoken words.

5. The toy of claim 1 wherein:

said indicia bearing member is circular, said indicia are angularly spaced, and said member is mounted within said housing for rotation.

6. The toy of claim 1 further comprising:

an obscuring member mounted on the outside of said housing for movement between a first position in which said obscuring member obscures at least a portion of said viewing window and a second position in which said elongated member does not obscure any portion of said viewing window.

7. The toy of claim 6 wherein:

said indicia bearing member and said obscuring member are coupled so that said indicia bearing member is moveable from its first position to its second position only when said obscuring member is in its first position.

8. The toy of claim 6 wherein:

said obscuring member is formed to emulate in appearance an upper extremity of said creature.

9. The toy of claim 7 further comprising:

an actuating linkage disposed in said housing and operably engageable with said indicia bearing member and said obscuring member; and an actuator engageable with said actuating linkage to actuate said actuating linkage.

10. A toy usable by a user comprising:

a housing having a viewing window formed therein;

an indicia bearing member disposed within said housing and bearing a first visual indicium expressive of a first emotional state and a second visual indicium expressive of a second emotional state, said indicia bearing member being mounted for movement between a first position in which said first visual indicium is visible from outside said housing via said viewing window and a second position in which said second visual indicium is visible from outside said housing via said viewing window;

first and second obscuring members disposed on said housing symmetrically about said viewing window and mounted for movement between respective first positions in which said obscuring members are adjacent and overlie said viewing window to obscure said viewing window and respective second positions in which said obscuring members are spaced and do not overlie said viewing window;

an actuator mounted to said housing and actuable by a user to initiate movement of said indicia bearing member and said obscuring members; and means engageable with, and responsive to actuation of, said actuator for coordinating and sequencing movement of said obscuring members and said indicia bearing member so that said obscuring members move to said first positions, said indicia bearing member next moves to said second position, and said obscuring members next move to said second positions.

11. The toy of claim 10 wherein said obscuring members are elongate, having opposed first and second ends, and are mounted for pivotal movement about said first ends thereof, said second ends thereof obscuring said viewing window in said first positions.

12. The toy of claim 11 wherein:

said housing includes a face portion formed to emulate in appearance the face of a creature having emotions;

said first and second visual indicia include representations of a mouth of said creature in different expressive states;

said viewing window has a portion positioned to correspond to the location of the mouth on said face portion of said housing; and each of said obscuring members is formed to emulate in appearance an upper extremity of said creature.

13. A method of simulating a change in emotional state of a toy emulating a creature capable of emotion and having a viewing area in which visual indicia representative of emotional states can be displayed and having means for generating audible outputs, comprising the steps of:

displaying in the viewing area a first visual indicium of a first emotional state;

obscuring said viewing area;

displaying in said viewing area a second visual indicium of a second emotional state; and generating an audible expression of said second emotional state.

14. The method of claim 13, wherein said toy includes an obscuring member moveable between a position in which the obscuring member obscures the viewing area and a second position in which the obscuring member does not obscure the viewing area; and said obscuring step comprises moving said obscuring member to its first position.

* * * * *